US007578140B1

(12) United States Patent
Wiggs

(10) Patent No.: US 7,578,140 B1
(45) Date of Patent: Aug. 25, 2009

(54) DEEP WELL/LONG TRENCH DIRECT EXPANSION HEATING/COOLING SYSTEM

(75) Inventor: B. Ryland Wiggs, Franklin, TN (US)

(73) Assignee: Earth To Air Systems, LLC, Franklin, TN (US)

( * ) Notice: Subject to any disclaimer, the term of this patent is extended or adjusted under 35 U.S.C. 154(b) by 162 days.

(21) Appl. No.: 10/804,698

(22) Filed: Mar. 19, 2004

Related U.S. Application Data

(60) Provisional application No. 60/456,335, filed on Mar. 20, 2003.

(51) Int. Cl.
*F25D 23/12* (2006.01)

(52) U.S. Cl. ..... 62/260; 165/45

(58) Field of Classification Search ..... 62/260, 62/184, 186, 498; 165/45
See application file for complete search history.

(56) References Cited

U.S. PATENT DOCUMENTS

| | | | |
|---|---|---|---|
| 2,503,456 | A | 4/1950 | Smith |
| 3,099,140 | A | 7/1963 | Leimbach |
| 4,094,356 | A | 6/1978 | Ash et al. |
| 4,169,554 | A | 10/1979 | Camp |
| 4,224,805 | A | 9/1980 | Rothwell |
| 4,257,239 | A | 3/1981 | Partin et al. |
| 4,378,787 | A | 4/1983 | Fleischmann |
| 4,448,237 | A | 5/1984 | Riley |
| 4,544,021 | A | 10/1985 | Barrett |
| 4,741,388 | A | 5/1988 | Kuroiwa |
| 4,993,483 | A | 2/1991 | Harris |
| 5,388,419 | A | 2/1995 | Kaye |
| 5,461,876 | A | 10/1995 | Dressler |
| 5,477,914 | A | 12/1995 | Rawlings |
| 5,533,355 | A | 7/1996 | Rawlings |
| 5,560,220 | A | 10/1996 | Cochran |
| 5,561,985 | A | 10/1996 | Cochran |
| 5,564,282 | A | 10/1996 | Kaye |
| 5,623,986 | A | 4/1997 | Wiggs |
| 5,651,265 | A | 7/1997 | Grenier |
| 5,671,608 | A | 9/1997 | Wiggs et al. |
| 5,706,888 | A | 1/1998 | Ambs et al. |
| 5,738,164 | A | 4/1998 | Hildebrand |
| 5,758,514 | A | 6/1998 | Genung et al. |
| 5,771,700 | A | 6/1998 | Cochran |
| 5,816,314 | A | 10/1998 | Wiggs et al. |
| 5,934,087 | A | 8/1999 | Watanabe et al. |

(Continued)

FOREIGN PATENT DOCUMENTS

| | | | |
|---|---|---|---|
| JP | 7-2699060 | A | 10/1995 |

(Continued)

*Primary Examiner*—Melvin Jones
(74) *Attorney, Agent, or Firm*—Miller, Matthias and Hull

(57) ABSTRACT

A direct expansion geothermal heat exchange system including certain line set sizes, distances, designs, depths, and lengths, including a long trench system design, certain vapor line coverings and moisturizing means, certain refrigerant operational pressures and type, certain pin restrictor sizes and locations, certain liquid line insulation lengths, certain containment pipe composition, pipe sizing with polyethylene, pipe antifreeze fill percentage, and pipe top sealing, a certain oil return safeguard procedure, certain interior heat exchanger design tonnages with predominate heating loads and with predominate cooling loads, a certain receiver type and capacity, an optional means of placing sub-surface refrigerant transport tubing within respective protective containment pipes, certain trench system and well/borehole system combinations, and certain trench creation means.

12 Claims, 10 Drawing Sheets

U.S. PATENT DOCUMENTS

| | | | | |
|---|---|---|---|---|
| 5,937,934 | A | 8/1999 | Hildebrand | |
| 5,941,238 | A | 8/1999 | Tracy | |
| 5,946,928 | A | 9/1999 | Wiggs | |
| 6,212,896 | B1 | 4/2001 | Genung | |
| 6,227,003 | B1 * | 5/2001 | Smolinsky | 62/324.1 |
| 6,276,438 | B1 | 8/2001 | Amerman et al. | |
| 6,354,097 | B1 * | 3/2002 | Schuster | 62/186 |
| 6,390,183 | B2 | 5/2002 | Aoyagi et al. | |
| 6,450,247 | B1 | 9/2002 | Raff | |
| 6,521,459 | B1 | 2/2003 | Schooley et al. | |
| 6,615,601 | B1 | 9/2003 | Wiggs | |
| 6,751,974 | B1 | 6/2004 | Wiggs | |
| 6,892,522 | B2 | 5/2005 | Brasz et al. | |
| 2002/0194862 | A1 * | 12/2002 | Komatsubara et al. | 62/474 |

FOREIGN PATENT DOCUMENTS

| | | | |
|---|---|---|---|
| JP | 9-196474 | A | 7/1997 |

* cited by examiner

DEEP WELL/LONG TRENCH DIRECT EXPANSION HEATING/COOLING SYSTEM

CROSS-REFERENCES TO RELATED APPLICATIONS

This application claims priority to U.S. Provisional Patent Application Ser. No. 60/456,335 filed Mar. 20, 2003, entitled "Deep Well/Long Trench Direct Expansion Heating/Cooling System", which is hereby incorporated by reference in its entirety.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

The present invention relates to an improved sub-surface, or in-ground/in-water, direct expansion heat pump system incorporating a unique combination of various design feature improvements, component strengthening criteria, air handler sizing, sub-surface vertical heat exchange design improvements, sub-surface near horizontal long trench designs, pin restrictor sizing criteria, insulation criteria improvements, and sub-surface heat exchange tubing containment pipe types and lengths for use in association with any direct expansion heating/cooling system, and particularly for use with a Deep Well Direct expansion (herein referred to as a "DWDX") system and a Long Trench Direct expansion (herein referred to as a "LTDX") system. A DWDX system is herein defined as a direct expansion system (also periodically referred to as a "direct exchange system" in the trade) which utilizes sub-surface heat exchange tubing in excess of 100 feet deep. The present invention may also be utilized in any direct expansion systems 100 feet, or less, in depth (near surface) with improved operational efficiency results. A LTDX system is herein defined as a direct expansion system which utilizes sub-surface heat exchange tubing installed in a near horizontal fashion at depths of less than 50 feet. Typically, LTDX systems will be installed at depths ranging from between 3 feet and 15 feet deep.

Ground source/water source heat exchange systems typically utilize fluid-filled closed loops of tubing buried in the ground, or submerged in a body of water, so as to either absorb heat from, or to reject heat into, the naturally occurring geothermal mass and/or water surrounding the buried or submerged tubing. Water-source heating/cooling systems typically circulate, via a water pump, water, or water with antifreeze, in plastic underground geothermal tubing so as to transfer heat to or from the ground, with a second heat exchange step utilizing a refrigerant to transfer heat to or from the water, and with a third heat exchange step utilizing an electric fan to transfer heat to or from the refrigerant to heat or cool interior air space.

Direct eXpansion (herein referred to as "DX") ground source systems, where the refrigerant transport lines are placed directly in the sub-surface ground and/or water, typically circulate a refrigerant fluid, such as R-22, in sub-surface refrigerant lines, typically comprised of copper tubing, to transfer heat to or from the sub-surface elements, and only require a second heat exchange step to transfer heat to or from the interior air space by means of an electric fan. Consequently, DX systems are generally more efficient than water-source systems because of less heat exchange steps and because no water pump energy expenditure is required. Further, since copper is a better heat conductor than most plastics, and since the refrigerant fluid circulating within the copper tubing of a DX system generally has a greater temperature differential with the surrounding ground than the water circulating within the plastic tubing of a water-source system, generally, less excavation and drilling is required, and installation costs are generally lower with a DX system than with a water-source system.

While most in-ground/in-water heat exchange designs are feasible, various improvements have been developed intended to enhance overall system operational efficiencies. Various such design improvements are taught in U.S. Pat. No. 5,623,986 to Wiggs; in U.S. Pat. No. 5,816,314 to Wiggs, et al.; in U.S. Pat. No. 5,946,928 to Wiggs; in U.S. Pat. No. 6,615,601 B1 to Wiggs; in Wiggs' U.S. patent application Ser. No. 10/073,513; in Wiggs' U.S. patent application Ser. No. 10/127,517; in Wiggs' U.S. patent application Ser. No. 10/251,190; in Wiggs' U.S. patent application Ser. No. 10/335,514; in Wiggs' U.S. patent application Ser. No. 10/616,701, and in Wiggs' U.S. patent application Ser. No. 10/757,265, the disclosures of which are incorporated herein by reference.

In DX applications, supply and return refrigerant lines may be defined based upon whether they supply warmed refrigerant to the system's compressor and return hot refrigerant to the ground to be cooled, or based upon the designated direction of the hot vapor refrigerant leaving the system's compressor unit, which is the more common designation in the trade.

For purposes of this present invention, when applicable, the more common definition will be utilized. Hence, supply and return refrigerant lines are herein defined based upon whether, in the heating mode, warmed refrigerant vapor is being returned to the system's compressor, after acquiring heat from the sub-surface elements, in which event the larger interior diameter, sub-surface, vapor/fluid line is the return line and evaporator, and the smaller interior diameter, sub-surface, liquid/fluid line, operatively connected from the interior air handler to the sub-surface vapor line, is the supply line; or whether, in the cooling mode, hot refrigerant vapor is being supplied to the larger interior diameter, sub-surface, vapor fluid line from the system's compressor, in which event the larger interior diameter, sub-surface, vapor/fluid line is the supply line and condenser, and the smaller interior diameter, sub-surface, liquid/fluid line is the return line, via returning cooled liquid refrigerant to the interior air handler, as is well understood by those skilled in the art. In the heating mode the ground is the evaporator, and in the cooling mode, the ground is the condenser.

As taught by Wiggs in the above-said patents and/or patent applications, an improved means of designing a DX system for a reverse-cycle heating/cooling system operation consists of insulating only one smaller interior diameter, sub-surface, line, designed primarily for liquid/fluid refrigerant transport, which smaller line may be utilized as a supply line in the heating mode and as a return line in the cooling mode, and of not insulating at least one, or two or more combined, larger interior diameter, sub-surface, lines, designed primarily for vapor/fluid transport, which can provide expanded surface area thermal heat transfer as return lines in the heating mode and as supply lines in the cooling mode. This design improvement applies to any DX system, including a DWDX system and a LTDX system. While at least two, larger combined interior diameter, vapor/fluid refrigerant transport lines, operatively connected to one, smaller interior diameter, liquid/fluid refrigerant transport line would generally be preferable because of the resulting expanded, and spaced apart, heat transfer surface contact area, instances may arise where only one, larger interior diameter, vapor/fluid refrigerant line, operatively connected to one, smaller interior diameter, liquid/fluid-refrigerant line could also be preferable, or where a larger interior diameter vapor/fluid refrigerant line is spiraled around a centrally located, insulated, smaller diameter liquid/fluid refrigerant line could be preferable.

Where a close to zero-tolerance short-circuiting effect is desirable, and where the time and expense of constructing other designs, such as a concentric tube within a tube, or a spiraled single fluid return line and single fluid supply line of the same sized interior diameters, could be financially, or functionally and/or efficiently, prohibitive in a deep well direct expansion application, and where the thermal exposure area of a single geothermal heat transfer line, or tube, could be too centralized and too heat transfer restrictive, a system design improvement would be preferable which incorporated a cost-effective installation method, capable of operating in a reverse-cycle mode in a sub-surface direct expansion application, with close to zero-tolerance short-circuiting effect, with expanded sub-surface heat transfer surface area capacities, and with a liquid refrigerant trap means at the bottom of the sub-surface heat exchange lines to assist in preventing refrigerant vapor migration, from the refrigerant vapor line into the refrigerant liquid line, as is taught in Wiggs' pending U.S. patent application Ser. No. 10/251,190, which is incorporated herein by reference.

Virtually all heat pump systems, including direct expansion heat pump systems, utilize a compressor, an interior heat exchange means, an exterior heat exchange means, thermal expansion devices, an accumulator, a receiver, and refrigerant transport tubing. Generally, most direct expansion systems are designed to utilize, and utilize, conventionally sized equipment components, as explained in Wiggs' U.S. patent application Ser. No. 10/757,265, which is incorporated herein by reference. For example, a three ton conventional direct expansion system, designed to accommodate a three ton heating/cooling load as per ACCA Manuel J load calculations or other similar design criteria, typically utilizes a 3 ton compressor, a 3 ton air handler (a common interior heat exchange means), a 3 ton design capacity sub-surface heat exchange means (often about 5 horizontal 100 foot long ¼" diameter refrigerant grade copper tubes per ton, a 3 ton metering device (typically one self-adjusting thermal expansion valve for each of the cooling and heating segments), a 3 ton accumulator, a 3 ton receiver (with various other receiver designs, claimed or utilized, based upon about a 50% greater to a 50% smaller size of the compressor tonnage size utilized, as explained in U.S. Pat. No. 5,946,928 to Wiggs, which is incorporated herein by reference), and standard 3 ton design refrigerant transport tubing (such as a ⅜" diameter refrigerant grade copper liquid/fluid transport line and a ⅞' diameter refrigerant grade copper vapor/fluid transport line) to and from the compressor unit, the heat exchange means, and the other system components.

An improved design for conventional near-surface and other direct expansion heating/cooling systems is also taught in the said U.S. Pat. No. 5,946,928 to Wiggs. Conventional direct expansion systems typically require a relatively large surface area of land within which to bury an array of heat exchange tubing. While for new residential construction on relatively large lots, such designs can be well suited, the large surface area excavation requirements are often not well suited for retrofit applications, and are usually not well suited for most commercial applications, due to restricted available land surface areas.

To overcome such conventional direct expansion system application shortcomings, various designs have been developed to permit the installation of sub-surface heat exchange tubing in sub-surface tubing installed at depths of 100 feet, or more, such as those designs taught by Wiggs in various of the above-referenced patents and patent applications. However, a means to install a highly efficient DX system without having to incur drilling expenses, while permitting sub-surface heat exchange tubing to be located around the perimeter of a property, for example, rather than taking up a large portion of the entire yard area utilizing a matrix of heat exchange tubing requiring about 500 square feet or more per ton of design capacity, can also be advantageous. Thus, it is an objective of this subject invention to both disclose various design improvements for a DWDX system, for DX systems in general, and to disclose means of installing improved DX system designs in conjunction with a near surface LTDX geothermal heat exchange system The present invention provides solutions to these preferable objectives, as hereinafter more fully described.

BRIEF SUMMARY OF THE INVENTION

It is an object of the present invention to further enhance and improve the efficiency of predecessor direct expansion geothermal heat exchange system designs by means of teaching certain line set sizes, distances, designs, depths, and lengths, including a long trench system design, certain vapor line coverings and moisturizing means, certain refrigerant operational pressures and type, certain pin restrictor sizes and locations, certain liquid line insulation lengths, certain containment pipe composition, pipe sizing with polyethylene, pipe antifreeze fill percentage, and pipe top sealing, a certain oil return safeguard procedure, certain interior heat exchanger design tonnages with predominate heating loads and with predominate cooling loads, a certain receiver type and capacity, an optional means of placing sub-surface refrigerant transport tubing within respective protective containment pipes, certain trench system and well/borehole system combinations, and certain trench creation means.

Refrigerant system design components are all operatively connected via refrigerant transport tubing, as is well understood by those skilled in the art. All DX systems described herein are electrically powered. Electrical power lines and electrical connections are not shown herein as they are well understood by those skilled in the art. All refrigerant transport tubing referenced is sized for refrigerant grade copper tubing, which sizing/dimensions are well understood by those skilled in the art. All calculations of the maximum heating/cooling load are made via conventional ACCA Manuel J load calculations, or other similar conventional load design criteria. Heating/cooling load designs are typically calculated in tonnage design capacities, where 12,000 BTUs equal one ton of design capacity. ACCA Manuel J heating/cooling load calculations are well understood by those skilled in the art.

While minimum requisite sub-surface refrigerant tubing design lengths for the heat exchange vapor line have been disclosed for a DWDX system, and claimed for any direct expansion system application, in the aforesaid Wiggs' U.S. patent application Ser. No. 10/757,265, such designs would, for clarification, also be applicable for any near-surface direct expansion system application, at any depth, including a LTDX, whether or not the liquid refrigerant transport line paralleled the entire length of the sub-surface geothermal heat exchange vapor line, as follows:

providing exterior, sub-surface, geothermal vapor refrigerant transport tubing design lengths, at any depth, at a minimum of 100 feet per ton of maximum system tonnage design when the heat exchange vapor line is within 95%, or greater, rock, where rock excludes pumice, obsidian, and all other porous rock that is not permanently water saturated;

providing exterior, sub-surface, geothermal vapor refrigerant transport tubing design lengths, at any depth, at a minimum of 110 feet per ton of maximum system tonnage design when the heat exchange vapor line is within 80%, or greater, rock, or is within permanently water saturated sand, where rock excludes pumice, obsidian, and all other porous rock that is not permanently water saturated;

providing exterior, sub-surface, geothermal vapor refrigerant transport tubing design lengths, at any depth, at a minimum of 125 feet per ton of maximum system tonnage design when the heat exchange vapor line is within soil; excluding soil containing 20%, or more, of clay and/or sand that is not permanently moist; and providing exterior, sub-surface, geothermal vapor refrigerant transport tubing design lengths, at any depth, at a minimum of 175 feet per ton of maximum system tonnage design when the heat exchange vapor line is within soil containing 20%, or more, of clay and/or sand that is not permanently moist.

Additionally, while the optimum design sizing to be used for the refrigerant grade copper tubing used to connect the interior equipment, such as the compressor unit and the air handler, with the exterior sub-surface heat exchanger lines have been disclosed for a DWDX system in the aforesaid Wiggs' U.S. patent application Ser. No. 10/757,265, such designs would, for clarification, also be applicable for any near-surface direct expansion system application, at any depth, including a LTDX, for any refrigerant grade tubing/line sizes, where the connecting refrigerant grade tubing/lines are sized to match the system's compressor' maximum tonnage design capacity as follows:

for a 12,000 BTU through 30,000 BTU compressor size, use a ⅜ inch liquid line and a ¾ inch vapor line;

for a 36,000 BTU through 48,000 BTU compressor size, use a ½ inch liquid line and a ⅞ inch vapor line; and for a 54,000 BTU through 60,000 BTU compressor size, use a ½ inch liquid line and a 1 inch vapor line.

Additionally, so as to prevent any potential geothermal heat gain/loss "short circuiting' effect, it is important to provide a fully insulated sub-surface liquid refrigerant transport line whenever the sub-surface liquid refrigerant transport line is within at least a 10 foot distance of the un-insulated vapor refrigerant transport line.

While a LTDX system may be installed via the installation of a, or multiple, sub-surface vapor refrigerant transport line (s), in an extended manner, where the accompanying liquid line within the trench is fully insulated, as a unique option available with a LTDX design, the exterior liquid refrigerant transport line solely needs to extend to the coupling point with the exterior vapor refrigerant transport heat exchange line, or lines when multiple vapor heat exchange lines are utilized by means of a vapor line distributor, and does not have to parallel the vapor line as it necessarily would in a DWDX or other vertical application. Thus, only the portions of the exterior liquid line, and only the portions of the exterior vapor line(s), within a distance of three feet below the maximum frost line in the particular geographic area, and within a close enough proximity to potentially freeze one of a water line, a sewer line, and water/liquid adjacent to a structural wall need to be insulated. In such an optional design, the vapor heat exchange line(s) would be installed in a manner so that the exterior heat exchange vapor line returned in a looped manner, although the actual configuration of the vapor line could be square, zig-zaged, circular, or the like. The geothermal heat transfer un-insulated portions of the exterior vapor refrigerant transport line must always be at a depth of at least 3 feet below the maximum frost line in the particular geographic location of system installation so as to avoid material adverse effects from atmospheric temperature fluctuations. Such an un-insulated geothermal heat exchange vapor refrigerant transport line/tube, could also be snaked or coiled within an excavated wide area pit.

Providing at least one un-insulated heat exchange vapor refrigerant transport line within one of a trench and a pit for purposes of geothermal heat transfer, where such vapor line is operatively connected to the direct expansion system's interior equipment at one end (as is well understood by those skilled in the art) and is operatively connected to at least one liquid refrigerant transport line at the other end (which liquid line is then operatively connected to the system's interior equipment, as would be well understood by those skilled in the art), which liquid line is one of insulated and un-insulated. As long as the said liquid line is at the same, or deeper, operative depth as the heat transfer vapor line, there is typically no need to insulate same since the exposed liquid line will generally only provide additional and advantageous heat transfer contact surface area. Should multiple geothermal heat transfer vapor lines be utilized via a distributor (a distributor is well understood by those skilled in the art), then such multiple lines would be operatively connected to an equal number of distributed insulated liquid refrigerant transport lines/tubes, as would be well understood by those skilled in the art.

While water-source geothermal heat pump systems often utilize a trench to install their plastic water transport pipe/tubing for geothermal heat transfer purposes, such pipe/tubing virtually always consist of a loop of un-insulated pipe/tubing, which pipe/tubing has been coupled together at the distal end of the loop. Thus, there is always some adverse geothermal heat transfer "short circuiting" effect. It would typically not be financially feasible for a water-source system to install only one heat exchange line in a trench because their operational design temperature differentials between the circulated water and the surrounding ground are generally only about 10 degrees to 15 degrees F., and the installation/excavation cost would double if the requisite length of plastic geothermal heat exchange pipe was installed in only a single pipe/tube manner.

However, since the operational design temperature differentials, between the circulated refrigerant and the surrounding ground, of a LTDX system are typically significantly greater, and sometimes exceeding 100 degrees F., an equivalent amount of geothermal heat transfer in BTUs/Ft.Hr. degrees F. can be accomplished in significantly less distance by only a single vapor refrigerant transport line/tube, sometimes in only about 50% of the distance required by a double loop of a water-source water transport pipe/tube. This tested factor can provide a significant economic advantage when utilizing a near-surface LTDX system design, and can permit the installation of a near-surface geothermal system on a significantly smaller lot than could possibly be serviced by a conventional water-source trench system.

In a LTDX application, the exterior heat transfer vapor line must be one of horizontally positioned and generally sloped downwardly to the coupling with the liquid line at the lowest point of the vapor line, so as to always allow any un vaporized and liquid refrigerant to accumulate at the lowest point in the heat exchange field proximate to the actual liquid refrigerant transport line.

In a LTDX application, the exterior heat transfer vapor line(s), in order to optimize geothermal heat transfer, should be covered with a good heat conductive material, such as one of a heat conductive grout (such as grout 111, or the like), a concrete mixture, a cement mixture, silica sand, powdered stone, finely chipped stone (no larger than ¼ inch chips, and preferably smaller), or the like. Additionally, a perforated soaker hose should be placed on top of the heat conductive material covering the exterior heat transfer vapor line(s).

The perforated soaker hose runs the entire length of the geothermal heat transfer portion of the trench, or trenches, with its terminal and distal end preferably sealed shut. The soaker hose may consist of a perforated garden hose, perforated PVC tubing, perforated plastic tubing, or the like.

The perforated soaker hose may be connected and distributed, from an original single water supply hose, to multiple trenches when applicable. Sealing the distal end(s) of the soaker hose permits water pressure to evenly force water out of the perforations when the hose is filled with pressurized water from an above-surface water-faucet, or the like. The above-surface end of the soaker hose will typically be fitted with a screw attachment for easy connection to an exterior water faucet. As the rejection of heat through the exterior heat transfer vapor line occurs in the cooling mode of operation, surrounding earth may tend to dry out and/or shrink away from the hot vapor line, thereby reducing heat transfer abilities. Should this occur, the soaker hose can be turned on and filled with water so as to re-supply moisture and close any air gaps occasioned by ground shrinkage/withdrawal. Alternately and preferably, the DX system's condensate drain line should be channeled into the top of the soaker hose so as to continuously supply moisture to the sub-surface vapor line(s) when the system is operating.

As the exterior geothermal heat transfer vapor line of a LTDX system will virtually always be composed of copper, it can be less expensive, and therefore sometimes preferable, to utilize multiple smaller vapor lines when geothermal heat exchange lengths in excess of 300 feet are necessary, with such multiple smaller vapor refrigerant transport lines being distributed from the one original larger vapor line (refrigerant line distributors are well understood by those skilled in the art).

A preferred means of designing a direct expansion geothermal heat exchange system comprising providing sizing for multiple distributed LTDX system exterior, sub-surface, liquid refrigerant transport lines/tubes, and for sizing multiple distributed LTDX system exterior, sub-surface, vapor refrigerant transport lines/tubes, based upon maximum system compressor tonnage (where 1 ton equals 12,000 BTUs) design size capacity, is as follows:

for a 12,000 BTU through a 30,000 BTU compressor size, use one ⅜ inch Liquid Line and one ¾ inch Vapor Line in one trench for all standard designs up to 125 feet per ton, with the one exception of when any one trench exceeds 300 feet in length, and in such event, two equally sized trenches must be used, with each respective trench utilizing one ⅜ inch Liquid Line and one ¾ inch Vapor Line; and for a 36,000 BTU through 60,000 BTU compressor size, use two trenches, with each respective, and equally sized, trench containing a respective ⅜ inch Liquid Line and a respective ¾ inch Vapor Line, with the one exception of when any two trenches, respectively exceed 300 feet in length each, and in such event, three equally sized trenches must be utilized as necessary, with each respective trench utilizing one ⅜ inch Liquid Line and one ¾ inch Vapor Line.

All un-insulated subsurface refrigerant transport geothermal heat transfer tubing in a LTDX design should be kept at a minimum distance of 10 feet away from any other un-insulated subsurface refrigerant transport geothermal heat transfer tubing, except at sub-surface distributor locations where close proximity is mandatory. Such spacing materially assists in avoiding undue depletion of the ground's heat transfer abilities, which was a problem with some older, conventional, near surface, DX system designs where the sub-surface heat transfer tubing was permitted to be spaced in closer proximity.

While the advantage of utilizing a refrigerant with greater working pressures than R-22 for a DWDX system has been disclosed in the aforesaid Wiggs' U.S. patent application Ser. No. 10/757,265, testing has shown that the use of a refrigerant with greater working pressures than R-22 for virtually any DX system results in increased operational efficiencies. This is generally because virtually any DX design, unlike conventional air-source heat pumps, always has its exterior heat exchange field located below the system's compressor unit. Consequently, the utilization of a higher pressure refrigerant than R-22 materially assists in offsetting the adverse affects of gravity when the system is operating in the cooling mode and condensed liquid refrigerant must be returned uphill against the force of gravity. Compressors are designed to act as compressors, not as liquid refrigerant pumps. Thus, the utilization of a higher pressure refrigerant materially assists any DX system via increasing operational efficiencies as the liquid refrigerant pumping requirements placed upon the compressor in the cooling mode is eased.

Testing has shown that the use of a refrigerant with at least a 33.3% increase in system operational pressures over the operational pressures of R-22, which pressures are well understood by those skilled in the art, are required to materially assist the operational efficiencies of any DX system, including a DWDX and a LTDX system design. R-410A has at least a 33.3% increase in system operational pressures over the operational pressures of an R-22 based DX system.

Virtually all direct expansion heating/cooling systems operate via utilization of R-22 refrigerant. However, the use of an R410A refrigerant, even though presently more expensive than R-22, as an additional benefit, can periodically increase a direct expansion system's operational efficiencies because R410A can have better heat transfer efficiencies, particularly in the cooling mode under approximate 55 degree F. condensing temperature conditions where direct expansion systems generally operate. Other alternative refrigerants, such as R-134A, although capable of use in a direct expansion system, would not be preferred because R-134A generally has a lower heat transfer capacity than R-22 and would, therefore, require larger equipment and longer sub-surface heat exchange tubing. Thus, a preferred direct expansion heating/cooling system design would incorporate the use of R410A refrigerant to charge the system and to operate as the refrigerant fluid within the system, instead of R-22. However, while R410A generally has as good as, and periodically better than, heat transfer capacity as R-22, R410A refrigerant will generally operate at 33.3%, and higher, increased operational working refrigerant pressure than R-22. Thus, when utilizing R410A, all components of the direct expansion system must be designed and strengthened to withstand the corresponding increase in operational working pressures, which will be at least 33% greater operational working refrigerant pressures than the operational working refrigerant pressures that are typically designed and strengthened for R-22 use. The designing and strengthening of all components of a direct expansion system to withstand operational working refrigerant pressures at least 33% greater than the design for use with R-22 is well understood by those skilled in the art. R-22 and R-410A refrigerants are ASHRAE designated refrigerant type numbers, as is well understood by those skilled in the art.

Further, via utilizing R-410A refrigerant instead of R-22 in a direct expansion system, the system's head pressure and suction pressure (as are well understood by those skilled in the art) remain more constant and predictable as a result of the increased refrigerant internal pressure. Also, as explained, this increased internal pressure helps to facilitate the return of liquid refrigerant to the surface when a DWDX system is operating in the cooling mode and the ground is the condenser.

Lastly, when preferably utilizing an R-410A refrigerant, or the like, in a direct expansion heating/cooling system, a filter/dryer (as is well understood by those skilled in the art) should preferably be installed and should be over-sized. Preferably, the filter/dryer should be sized at least 10% larger than the conventional size used in an R-22 based system (conventional sizing for a filter/dryer in an R-22 based system is well understood by those skilled in the art) which is designed to accommodate the refrigerant charge of the system's maximum design tonnage capacity. This minimum 10% over-sizing of the filter-dryer is a preferred utilization design/method when utilizing R-410A because R-410A will operate more efficiently in conjunction with a polyol ester compressor lubricating oil than with other types of oil, such as a Suniso refrigeration oil 3GS (commonly used with R-22), and a polyol ester oil more readily absorbs water vapor/moisture than other conventional oils. Water vapor/moisture within a refrigerant-based heating/cooling system can cause corrosion within system components. Therefore, at least a 10% larger than customarily normal filter/dryer than that used for an R-22 based system should be utilized in a direct expansion system when utilizing an R410A refrigerant, which is a preferable refrigerant to utilize in a direct expansion heating/cooling system for the reasons stated above. The over-sized filter/dryer may be located at a point between the system's receiver and the system's single piston metering device.

A filter/dryer has built in check valves, or the like, which serve to ensure the flow of the refrigerant through the filter/dryer is always in the same direction, regardless of operation in either the heating mode or the cooling mode (as is well understood by those skilled in the art).

Thus, in any direct expansion system, the use of an R410A refrigerant would be preferred, at least a 33.3% system component strengthening would be mandatory, the use of a Polyol Ester lubricating oil would be preferred for the system's compressor, and the system's filter dryer should preferably be oversized by a factor of at least 10% above the size of filter dryers used within R-22 system designs.

In a DWDX system design, while a fully insulated liquid line is generally preferable, testing has indicated that, in order to more fully utilize the deep well stable temperature advantages, it can be advantageous to only insulate the top 75%, plus or minus 5% of 100%, portion of the liquid line within the borehole/well. By only insulating the top 75%, one effectively exposes 25% of the liquid line to the most stable portion of the geothermal temperatures, this, in effect, provides an additional 25% of refrigerant heat transfer line exposure where geothermal temperatures are the most stable.

Further, the lower 25% segment of a DWDX system is typically either in rock or in water, which supplies superior heat conductivity results. Testing has indicated that the minor heat transfer "short-circuiting" effect, resulting from the vapor line being proximately exposed to the liquid line, is relatively minor, and can be more than offset by the additional refrigerant transport tubing exposure at this premium depth, far away from near-surface temperature fluctuations caused by seasonal atmospheric conditions. The minor "short-circuiting effect can be further reduced via the preferable installation of insulation between, not around, the liquid line and the vapor line located within the lower 25%, plus or minus 5% of 100%, portion of the borehole. Thus, the lower, most stable, and generally most heat conductive, portion of the well/borehole contains 50% of the exposed refrigerant transport tubing length, when compared to the length of the vapor line alone. By fully insulating the upper 75% portion of the liquid line, the most significant area subject to a "short circuiting" effect remains fully protected.

While the advantage of utilizing an optional watertight containment pipe comprised of one of steel, galvanized steel, and polyethylene, for the containment of the sub-surface liquid refrigerant transport line and vapor refrigerant transport line(s) within a well/borehole has been disclosed in the aforesaid Wiggs' U.S. patent application Ser. No. 10/757,265, testing has indicated that steel pipes, even though fully coated with pipe dope at the threaded connection points, are prone to leaking. One solution, of course, would be to weld the steel pipe connections. However, welded joints cannot be reasonably tested as the pipe is immediately lowered into the ground. Consequently, an additional optional watertight pipe comprised of copper has been used and successfully tested. While a large diameter copper containment pipe (two inches or more in diameter) is more expensive than a comparably sized steel pipe, the copper can be silver soldered in a manner so as to virtually insure its watertightness.

While the use of multiple well/boreholes in a DWDX system application has been taught under specified conditions disclosed in the aforesaid Wiggs' U.S. patent application Ser. No. 10/757,265, testing has indicated that any such multiple wells/boreholes must be distanced from one another by at least 15 feet so as not to unduly impair sub-surface heat transfer abilities in the specific area.

Testing has also confirmed that the top of any containment pipe utilized in a DWDX application must be completely sealed at the top in a watertight manner after insertion of the refrigerant transport tubing, and after the pipe is filled with one of a fluid and a gel to the design level, so as to prevent loss of conductivity within the containment pipe occasioned by a loss of water or gel due to evaporation.

Testing has further indicated that when a containment pipe composed of polyethylene is utilized in a DWDX system application, or in a LTDX application in soils corrosive to copper, the design length of the containment pipe, and the refrigerant transport tubing contained within, must be increased by at least 5% due to the low heat conductivity rate of the polyethylene pipe's wall of only 0.225 BTUs/Ft.Hr. degrees F.

Testing has also indicated that in a properly designed DWDX system application, the water in a containment pipe does not generally fall below 28 degrees F. Thus, there is only a need to fill the pipe with at least a 20% mixture of propylene glycol antifreeze, rather than at least a 50% mixture, to be mixed with the remainder of the liquid or gel containment pipe fill material. Thus, a preferred means of designing a direct expansion geothermal heat exchange system, which includes a well/borehole system application where a containment pipe is utilized, is to fill the containment pipe with at least 20% of propylene glycol antifreeze, While the use of an oil separator and the addition of a specified amount of additional oil was disclosed in the aforesaid Wiggs' U.S. patent application Ser. No. 10/757,265, as an optional precautionary means of additionally insuring adequate oil return when the system is operating in the heating mode, the DWDX system, or any DX system, can be programmed to operate in the cooling mode for a 10 minute period once every 10 days. While operating in the cooling mode, any oil stuck within the sub-surface ground refrigerant tubing will be returned to the compressor as it is mixed with the returning liquid refrigerant. Although such a 10 minute cooling period will temporarily reduce the interior temperature, the brief cooling operational period will generally be materially unnoticeable. Any significant temperature drop will be automatically offset via operation of the auxiliary heat. In comparison to an air-source heat pump, such a brief period of cooling operation is minuscule. An air-source heat pump must typically operate in the cooling mode (a defrost cycle) for a period of between 3 to 10 minutes once every hour or so when the exterior temperatures are in the low 20s F, so as to melt the condensate ice that has built up on the exterior air heat exchange coils. Here, an operation in the cooling mode for only 10 minutes once every 10 days is only a safety margin designed to mix oil with the returning liquid refrigerant, as there is no requirement to melt exterior condensate ice.

While the use of a direct expansion system interior heat exchanger tonnage capacity designed at 140%, plus or minus 10% of 100%, of the maximum compressor tonnage design capacity was disclosed in the aforesaid Wiggs' U.S. patent application Ser. No. 10/757,265, testing has shown that this general purpose sizing criteria can be modified to produce increased efficiencies in geographic areas which require one of predominately heating and predominately cooling, where predominately is defined as 70%, or more, of the time.

In such geographic areas where operation in the heating mode is required 70%, or more, of the time, the interior heat exchanger tonnage capacity should be designed at 110%, plus or minus 10% of 100%, of the maximum compressor tonnage design capacity.

In such geographic areas where operation in the cooling mode is required 70%, or more, of the time, the interior heat exchanger tonnage capacity should be designed at 170%, plus or minus 10% of 100%, of the maximum compressor tonnage design capacity.

While the use of specific pin restrictor (Aeroquip type) sizing in a direct expansion system's heating mode of operation, utilizing an R-410A refrigerant, at varying depths and at varying compressor tonnage capacities was disclosed in the aforesaid Wiggs' U.S. patent application Ser. No. 10/757,265, the pin restrictor sizing decreased as borehole depths increased, due to increased liquid refrigerant head pressure, while the basic refrigerant charge remained relatively similar.

Additional testing has shown that the pin restrictor sizing can, alternately and preferably, remain the same at varying system operational depths so long as the refrigerant charge is adjusted and changed for each respective depth. Thus, the following single piston metering device pin restrictor (Aeroquip type) sizes (based on central bore hole size in inches) should be utilized in the heating mode, plus or minus a maximum of two (2) one thousandths of an inch (0.001) central bore hole size, at any depth, with the R410A refrigerant, or refrigerant with similar operating pressures and characteristics as R-410A, charge adjusted at each respective depth so as to provide optimum system operational efficiencies:

A preferred means of designing a direct expansion geothermal heat exchange system consists of providing pin restrictors (Aeroquip type) which are sized, plus or minus a maximum of two (2) one thousandths of an inch (0.001) central hole bore size, via the following table based upon the number of line sets and the maximum compressor tonnage design, while operating in the heating mode, where a single line set is comprised of one liquid line and one sub-surface geothermal heat exchange vapor line; where a double line set is comprised of two liquid lines and two sub-surface geothermal heat exchange vapor lines of approximate equal length and/or depth; where a triple line set is comprised of three liquid lines and three sub-surface geothermal heat exchange vapor lines of approximate equal length and/or depth, and where a pin restrictor of the prescribed size is placed within the liquid line of each respective line set:

| *For A Single Line Set Direct Expansion System | |
|---|---|
| 1.5 | 0.041 |
| 2 | 0.049 |
| 2.5 | 0.055 |
| 3 | 0.059 |
| 3.5 | 0.063 |
| 4 | 0.065 |
| 4.5 | 0.069 |
| 5 | 0.071 |

| *For A Double Line Set Direct Expansion System | |
|---|---|
| 1.5 | 0.029 |
| 2 | 0.035 |
| 2.5 | 0.039 |
| 3 | 0.042 |
| 3.5 | 0.045 |
| 4 | 0.046 |
| 4.5 | 0.049 |
| 5 | 0.050 |

| *For A Triple Line Set Direct Expansion System | |
|---|---|
| 1.5 | 0.024 |
| 2 | 0.028 |
| 2.5 | 0.032 |
| 3 | 0.034 |
| 3.5 | 0.036 |
| 4 | 0.038 |
| 4.5 | 0.040 |
| 5 | 0.041 |

When the said design criteria calls for two or three boreholes or trenches in conjunction with one compressor unit, respective pin restrictor housing and pin restrictors should be installed within each respective line set, at respective and approximately equally distanced points, between the liquid line distributor and the respective liquid line's coupling to the respective sub-surface geothermal heat exchange vapor line.

While the use of specific pin restrictor (Aeroquip type) sizing in a direct expansion system's cooling mode of operation, at a location proximate to the interior air handler, utilizing an R-410A refrigerant, at air handler (an air handler is a commonly used interior heat exchange means) heights up to 50 feet above the compressor and at varying compressor tonnage capacities was disclosed in the aforesaid Wiggs' U.S. patent application Ser. No. 10/757,265, testing has shown that the pin restrictor sizing can, alternatively and preferably, remain the same at varying system operational heights so long as the refrigerant charge is adjusted and changed for each respective height.

Thus, the following single piston metering device pin restrictor (Aeroquip type) sizes (based on central bore hole size in inches) should be utilized in the cooling mode, plus or minus a maximum of two (2) one thousandths of an inch (0.001) central bore hole size, at any height, as determined by means of the following table based upon one line set and the maximum compressor tonnage design, with the R410A refrigerant, or refrigerant with similar operating pressures and characteristics as R-410A, charge adjusted at each respective height so as to provide optimum system operational efficiencies:

| *(At any height of interior heat exchange means above the compressor unit) | |
|---|---|
| 1.5 | 0.058 |
| 2 | 0.070 |
| 2.5 | 0.077 |
| 3 | 0.085 |
| 3.5 | 0.093 |
| 4 | 0.099 |
| 4.5 | 0.100 |
| 5 | 0.112. |

While the use of a receiver designed to hold at least 40% of the maximum direct expansion system operational 410A refrigerant charge was disclosed in the aforesaid Wiggs' U.S. patent application Ser. No. 10/757,265, such a receiver should preferably be a dual direction receiver of a standard, non-variable capacity, design. While in U.S. Pat. No. 5,758,514 to Genung, et al., discloses the use of a an alleged improved receiver structure, the receiver disclosed by Genung is alleged not to be of a type available on the market (column 10, lines 56-59), but, instead, is a variable capacity receiver (column 17, lines 54-64) which is dual directional (column 18, lines 5-6), sized to hold up to approximately 30% of the R-22 system charge (column 10, lines 54-56). While receivers commonly on the market are neither of a variable capacity design, nor are of a combined variable capacity and dual directional design, receivers commonly on the market are one of single directional and dual directional, as is well understood by those skilled in the trade.

The uniqueness of Wiggs' aforesaid receiver claim for use in a DWDX application is its capacity to hold at least 40% of the maximum direct expansion system's operational R410A refrigerant charge. Neither the need nor the use of a 40% charge capacity receiver was ever envisioned by Genung because Genung only envisioned the use of a near-surface array heat exchange tubing for direct expansion system operational design purposes (column 3, lines 37-52), and because Genung's design utilized an R-22 refrigerant. An array of near surface heat transfer refrigerant transport tubes, as allegedly envisioned by Genung, consists of ¼ inch O.D. tubing which are enlongated from 500 feet to between 550 and 600 feet per ton of system capacity design (column 4, lines 18-38). As Genung solely envisioned the use of his unique variable capacity receiver to be that of enabling him to use such a larger, extended length array of heat exchange tubing (column 4, lines 46-50), there was no envisioned need of ever requiring a receiver to hold more than 30% of the system's charge. Further, as explained, since Genung's system solely utilized an R-22 refrigerant, Genung had no way of knowing what receiver capacity would be appropriate for an R-410A system design.

However, with Wiggs' DWDX design, testing has shown that a receiver must be able to hold at least 40% of the system's total operational R-410A refrigerant charge to properly function due to the significant depths, in excess of 100 feet deep, of the sub-surface liquid refrigerant transport line, or lines, which extend all the way to the bottom of a deep well/borehole. Further, testing has shown that a conventional dual directional receiver is preferable for use, although, as aforesaid, it must be uncommonly and uniquely sized to hold at least 40% of the total R-410A refrigerant charge rather than the commonly understood significantly lower quantity, as is well understood by those skilled in the trade.

Typically, in the direct expansion art, prior to Wiggs' disclosure of properly adjusted and sized system components to achieve maximum operational results, a 3 ton design load was generally sized with all 3 ton components. A conventional 3 ton receiver is designed for an air-source heat pump and is not designed for a 3 ton direct expansion system, as an air-source design requires only a minimally sized receiver. Testing has substantiated that neither Genung's 30% capacity receiver design, nor a conventional 3 ton air-source heat pump receiver design, even if the air-source design incorporated an R-410A refrigerant, has enough capacity to retain the necessary quantity of liquid refrigerant necessary to efficiently operate a reverse-cycle DWDX system.

Thus, until Wiggs built and tested his DWDX design utilizing R-410A, Wiggs' unique minimum 40% of total operational refrigerant capacity charge design was neither known nor envisioned by those skilled in the art. Since a LTDX system, with requisite lengths analogous to the requisite depths taught by Wiggs in a DWDX system design, may also be constructed with an insulated liquid refrigerant transport line running in parallel with the un-insulated vapor refrigerant transport line in the sub-surface geothermal heat exchange environment, the same minimum 40% of refrigerant capacity charge design would be required for such a LTDX design utilizing an R-410A refrigerant.

As an optional alternative to placing the sub-surface insulated liquid refrigerant transport tube and the sub-surface un-insulated vapor refrigerant tube within a single watertight containment pipe, whether in a DWDX or in a LTDX system application for purposes of refrigerant transport line protection from corrosive sub-surface environments, where the containment pipe is comprised of one of steel, galvanized steel, polyethylene, and copper, each respective refrigerant transport line may be placed in its own individual watertight containment pipe, with the two respective containment pipes joined in a U bend fashion at the distal end of the refrigerant transport tubing loop. Generally, the preferred type of protective watertight containment pipe in sub-surface environments corrosive to copper would be a polyethylene pipe, or the like, which non-metal pipe can generally withstand both low and high pH conditions which are corrosive to most metals.

While a DWDX system has been fully disclosed in the above-said Feb. 14, 2004, US Patent Application by Wiggs, while a conventional direct expansion horizontal heat exchange tubing array design has been disclosed by U.S. Pat. No. 5,946,928 to Wiggs, which Patent is hereby incorporated by reference, and while a trench design has been disclosed by Wiggs in his US Provisional Patent Application No. 60/456,335, filed on Mar. 20, 2003, which Provisional patent Application is incorporated herein by reference, an additional new geothermal direct expansion system sub-surface design may also be utilized for heating, cooling, and de-humidification purposes comprised of combining a trench and a deep well design.

One design for such a new trench and well/borehole combination would consist of installing an insulated copper liquid refrigerant transport line and an un-insulated copper vapor refrigerant transport line in a trench, typically about 4 to 15 feet deep (at least three feet below the maximum frost line in the area) with the terminal distal end/loop of the sub-surface heat exchange copper liquid and vapor refrigerant transport lines being placed within a well or within an excavated area extending to a depth in excess of that of the trench, such as to a depth of 20 to 300 feet, near the end of the subsurface geothermal refrigerant flow heat exchange path in the cooling mode od system operation. As with any trench system application, the vapor refrigerant line/tube within the trench must be one of substantially horizontal and downwardly slopping along the refrigerant flow path in the cooling mode of operation, so that liquid refrigerant will always drain, via gravity, into the liquid refrigerant transport line/tube in the cooling mode. As disclosed with individual well/borehole designs and with long trench design, such combined designs may be distributed into two or more geothermal heat exchange loops.

The advantage of combining a trench design with a deep borehole/deep terminal loop design is that the majority of sub-surface heat transfer can be accomplished in a near surface trench, which is less expensive to excavate than a borehole, while the maximum heat exchange advantage of a deeper well/borehole (which is relatively unaffected by near-surface atmospheric weather conditions) can be utilized to finalize and accentuate the best geothermal heat exchange medium before the refrigerant returns to the interior equipment.

A further design improvement for a trench and well/borehole combination system application would consist of solely placing an un-insulated vapor refrigerant transport line in a looped trench, which vapor line would connect to a fully insulated liquid refrigerant transport line at the deepest point of the sub-surface heat transfer area while operating in the cooling mode. In such a trench/well combination system, the vapor line would solely be placed in the extended trench, but would be looped back to a well/borehole location and coupled to liquid line near the bottom of the borehole, with an approximate one to two foot long U bend in the liquid line at the bottom of the borehole. The elimination of the necessity to place a fully insulated liquid line along the entire length of the vapor line, in a trench system application, saves materials costs, reduces installation time/labor, and reduces the amount of necessary refrigerant. As disclosed with individual well/borehole designs and with long trench designs, such combined designs may be distributed into two or more geothermal heat exchange loops.

Regarding the installation of a trench system, while one may typically utilize a trencher, a backhoe, an excavator, or the like to dig a trench within which the geothermal heat exchange tubing can be situated, such excavation loosens the soil at the top of the heat transfer lines and along their sides. While good compaction is assisted via covering the lines at the bottom of the trench with powdered stone, fine silica sand, or the like, the dirt backfilled into the trench is still generally looser than virgin soil. The looser the dirt surrounding the heat exchange tubing, the poorer the heat transfer ability. Further, conventional trenching creates surface ground disturbance that can disturb an existing lawn. Thus, a means of creating a trench with good bottom and side compaction, which creates minimal ground disturbance is preferable.

Such a trench may be created and effected by means of pressure driving a rugged plate, such as a steel plate or the like, into the ground along the path desired for the trench. The plate would preferably have a lower bottom comprised of a tapered blade, and would generally only need to be between one inch and three inches thick, as virtually all vapor refrigerant transport heat exchange lines utilized in a direct expansion trench system will be about one inch, more or less, in outside diameter, and as all insulated liquid refrigerant transport lines will generally not exceed approximately two inches in diameter (including the insulation). However, the rugged plate must be very strong, so as to satisfactorily break through rocks and compact the soil in a manner so as to maintain the narrow trench until the refrigerant transport tubing is installed and backfilled.

The depth of the plate will be determined by the desired depth of the trench, which must be at least three feet below the maximum frost line, and should generally be at least five feet deep regardless of the frost line depth so as to assist in mitigating very near surface atmospheric temperature effects upon the buried heat exchange tubing. The lower bladed portion of the plate could be one of straight, angled, curved, and rounded depending on whether the plate is to be driven into and through the ground by pressure and/or by hammering, or whether the plate is to be forced into the ground by weight or by hydraulic pressure or by other like means. With heavy enough available equipment, the plate could also have a front bladed edge and could be moved through the ground as a plow. The plate could also be comprised of a wheel, with extreme weight or pressure placed upon its central axel. In any event, the dirt displaced by one of the plate and the wheel would be forced into the adjacent ground, thereby increasing the density of the ground and enhancing geothermal heat transfer in the area directly adjacent to the copper heat transfer tubing. The copper heat transfer tubing is simply laid on the bottom of the trench, with the trench thereafter being backfilled by powdered limestone, silica sand, grout, concrete, cement, or the like.

Other customary direct expansion refrigerant system apparatus and materials would be utilized in a direct expansion system application, such as a reversing valve to change the direction of the refrigerant flow (except through the accumulator and compressor) when a reverse-cycle system is switched from a heating mode to a cooling mode and vice versa, distributors when multiple refrigerant lines are utilized, a thermostat, wiring, controls, refrigerant tube couplings, above-ground refrigerant transport line insulation (such as rubatex, or the like), and a power source, all of which are well-known to those skilled in the art and therefore are not all shown herein.

The subject invention may be utilized in whole, or in part, or by means of multiple units connected via headers/distributors, connecting sub-surface tubing in series or in parallel by means of common fluid supply and return refrigerant lines, to increase operational efficiencies and/or to reduce installation costs in a number of applications, such as in a deep well direct expansion system, or in a conventional geothermal direct expansion heat pump system, or in a long trench direct expansion system, or as a supplement to a conventional air-source heat pump system, water source heat pump system, or other conventional heating/cooling system, as is well understood by those skilled in the art, and, therefore, are not shown herein. The invention may be utilized to assist in efficiently heating or cooling air by means of a forced air heating/cooling system, or to assist in efficiently heating or cooling water in a hydronic heating/cooling system, as is also well understood by those skilled in the art, and, therefore is not shown herein.

BRIEF DESCRIPTION OF THE SEVERAL VIEWS OF THE DRAWINGS

There are shown in the drawings embodiments of the invention as presently preferred. It should be understood, however, that the invention is not limited to the precise arrangements and instrumentalities shown.

DETAILED DESCRIPTION OF THE INVENTION

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
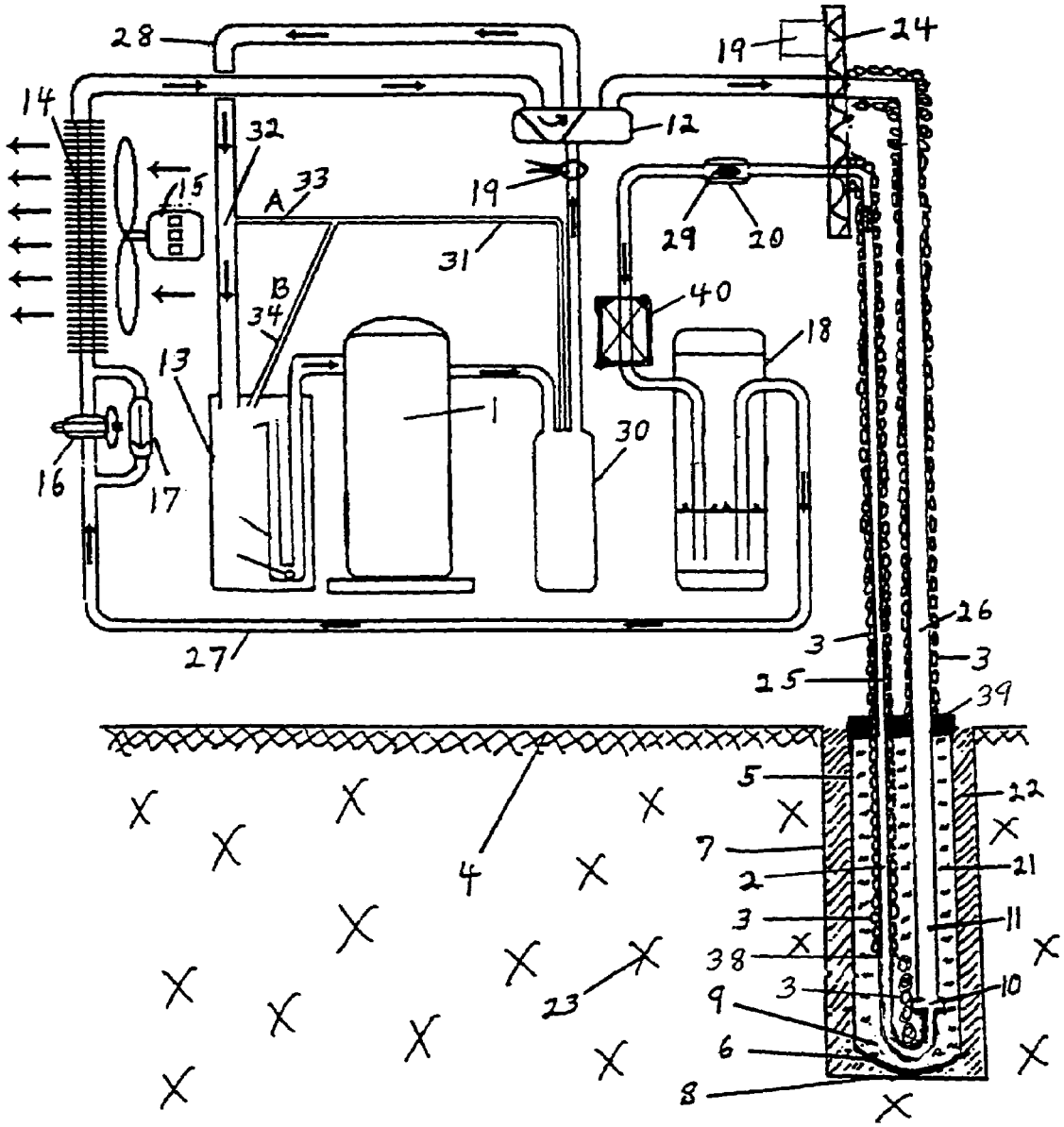
FIG. 1 is a side view of a simple version of a deep well direct expansion geothermal heat pump system, operating in a cooling mode, including smaller diameter sub-surface 75% insulated refrigerant fluid transport tubing coupled, above a U bend, to larger diameter sub-surface un-insulated refrigerant fluid transport/heat exchange tubing, all situated within a heat conductive fluid-filled watertight pipe in a deep well borehole with a sealed top, and operatively connected, by means of insulated exterior refrigerant fluid transport lines and interior insulated (not shown) refrigerant fluid transport lines, to an interior air heat exchange coil/air handler comprised of finned tubing, which have an adjacent fan to assist in heat transfer to and from interior air. Also shown is a thermal expansion valve for use in the cooling mode with a by-pass for the heating mode, a single piston metering device for use in the heating mode with its own internal by-pass for the cooling mode, an accumulator, a compressor, an oil separator with an oil return line to the refrigerant suction line entering one of the refrigerant vapor suction line and the accumulator, a receiver, a reversing valve, an oversized filter dryer, and a control means to override heating mode operation for a 10 minute period once every 10 days.

Referring now to the drawings in detail, where like numerals refer to like parts or elements, there is shown in FIG. 1 a side view of a simple version of a deep well direct expansion geothermal heat pump system, operating in a cooling mode.

A refrigerant fluid (not shown) is transported, by means of a compressor's 1 force and suction, inside a larger diameter un-insulated sub-surface refrigerant vapor transport/heat exchange line tube 11, which is located below the ground surface 4 within a heat conductive, watertight, polyethylene pipe 5, which is five percent (not shown in comparative scale) longer than a similar pipe (not shown) constructed of steel or copper would be. A smaller diameter sub-surface liquid refrigerant transport line tube 2, which is surrounded by insulation 3 to a depth point 38 which is 75% from the ground surface 4, also extends within the heat conductive, watertight pipe 5 all the way to the pipe's sealed lower end/bottom 6, which pipe 5 has been inserted into a deep well borehole 7 all the way to the bottom 8 of the deep well borehole 7. As the sub-surface liquid refrigerant transport tube 2 reaches the sealed pipe bottom 6, the sub-surface liquid tube 2 forms a U bend 9, which constructively acts as both an oil trap and a liquid refrigerant trap, and the sub-surface liquid tube 2 is thereafter coupled, with a refrigerant tube coupling 10, to the larger diameter un-insulated sub-surface refrigerant vapor transport/heat exchange tube 11. As the refrigerant fluid flows down within the larger diameter un-insulated sub-surface refrigerant transport/heat exchange line tube 11, on its way to the smaller diameter sub-surface liquid refrigerant transport line tube 2, the refrigerant transfers heat into the cooler natural earth 23 geothermal surroundings below the ground surface 4 and is condensed into a cool liquid refrigerant form, as heat always travels to cold. From the depth point 38 which is 75% from the ground surface 4 to the sealed pipe lower distal end/bottom 6, insulation 3 is solely placed between the smaller diameter sub-surface liquid refrigerant transport line tube 2 and the larger diameter sub-surface refrigerant transport/heat exchange line tube 11, with the insulation 3 not being placed around either refrigerant tube 3 and 11.

The cooled refrigerant fluid, which has rejected excessive heat into the earth 23 below the ground surface 4, condenses into a mostly liquid refrigerant form and travels up from the U bend 9 near/at the sealed pipe's lower end/bottom 6 into an exterior refrigerant transport liquid line tube 25, which is surrounded by insulation 3, through an exterior structure wall 24, and into interior liquid refrigerant transport line tubing 27. The liquid refrigerant then travels around and through the pin restrictor 29 (in the heating mode, which is not shown as the reverse cycle mode of operation is well understood by those skilled in the art, the refrigerant flows in a reverse direction only through the hole in the center of the pin restrictor 29, and not additionally around the pin 29, so that the flow of the refrigerant is restricted and metered, as is well understood by those skilled in the art) within the single piston metering device 20, through the dual directional receiver 18, which, with its capacity to hold at least 40% of the system's R-410A refrigerant charge (not shown), automatically adjusts the optimum amount of refrigerant charge flowing through the system in each of a heating mode and a cooling mode. The size of the pin restrictor 29 is adjusted as taught herein, depending on the size of the system's compressor 1. Additionally, the single piston metering device 20 and its pin restrictor 29, as shown herein in a correct location for operation in a heating mode, would additionally be located in the place of the self-adjusting thermal expansion valve 16 and its by-pass line 17 if the optional use of a piston metering device 20 and its pin restrictor 29 were selected for use in place of the thermal expansion valve 16 and its by-pass line 17 for use in the cooling mode of operation. Since the use of a piston metering device 20 and its pin restrictor 29 is only an option in the cooling mode, and since the substitution of same would be in the same location as that of the self-adjusting thermal expansion valve 16 and its by-pass line 17 shown herein, as is well understood by those skilled in the art, the optional piston metering device 20 and its pin restrictor 29 is not shown herein in its optional location in the cooling mode, which optional location has been explained.

The refrigerant then flows through the self-adjusting thermal expansion valve 16 (a thermal expansion valve by-pass line 17 is shown, but would only be used in the reverse-cycle heating mode of operation, as is well understood by those skilled in the art), and next through interior located finned heat exchange tubing 14, also commonly called an air handler, with an adjacent fan 15 designed to blow hot interior air over the cooler refrigerant fluid within the finned heat exchange tubing 14 so as enable the cooler refrigerant to absorb and remove excess heat from the interior air. The size of the interior located finned heat exchange tubing 14 is adjusted (not shown herein) to a larger size in a predominately cooling environment, and to a smaller size in a predominately heating environment, as taught herein. The manner in which to increase and to decrease the size of the interior located finned heat exchange tubing 14 (typically an air handler) is well understood by those skilled in the art.

The warmed refrigerant fluid, having absorbed excessive heat from the interior air, is transformed into a mostly vapor state, and then flows through an interior located reversing valve 12, into an accumulator 13, which catches and stores any liquid refrigerant which has not fully evaporated, and then travels into the compressor 1. The accumulator 13 has an accumulator interior refrigerant vapor suction line 35 which is open at the top 36, so as to help ensure only vapor is pulled into the compressor 1, and has a small hole 37 in the bottom of the accumulator interior refrigerant vapor suction line 35, so as to provide a means for settled and accumulated refrigerant oil (not shown), which is preferred to be a polyol ester oil for use with R-410A, to be sucked back into the compressor 1. The compressor 1 compresses the cooler refrigerant vapor into a hot refrigerant gas/vapor. The hot refrigerant vapor then travels, by means of the force of the compressor 1, through the oil separator 30. The oil separator 30 has a small oil return line 31 that returns oil, which has escaped from the compressor 1, to the suction line portion 32 of the interior vapor refrigerant transport line tubing 28, which suction line portion 32 is located prior and proximate to the accumulator 13, by means of oil return line alternate route A 33. In an alternative, the oil could be returned, by means of the oil return line 31, directly into the accumulator 13, as is shown herein by means of oil return line alternate route B 34. The refrigerant fluid then travels through the interior located reversing valve 12, back through the exterior structure wall 24, through the exterior refrigerant transport vapor line tube 26, which is surrounded by insulation 3, and back into the larger diameter un-insulated sub-surface refrigerant vapor transport/heat exchange line tube 11, which is located below the ground surface 4, where the geothermal heat exchange process is repeated.

All above ground surface 4 interior liquid refrigerant transport line tubing 27, and all above ground surface 4 interior vapor refrigerant transport line tubing 28, are fully insulated with rubatex, or the like, as is common in the trade, which is well understood by those skilled in the art and, therefore, is not shown herein.

At least a 10% larger than an R-22 refrigerant system's customarily normal filter/dryer 40 is shown at a point between the receiver 18 and the single piston metering device 20.

So as to avoid non-heat conductive air gaps, the remaining interior portion of the heat conductive watertight pipe 5, located below the ground surface 4, is filled with a heat conductive fluid mixture of 80% water and 20% propylene glycol anti-freeze 21. For a similar purpose, the space below the ground surface 4, between the exterior wall of the pipe 5 and the interior wall of the deep well borehole 7, is filled with a heat conductive grout 22, which is in direct thermal contact with the adjacent and surrounding earth 23. The heat conductive watertight pipe 5 has a sealed top 39 so as to prevent the escape of moisture by means of evaporation.

A control means 19 designed to operate the compressor 1 in the cooling mode of operation for a ten minute period once every ten days during the heating season is shown as attached to the inside of the exterior structure wall 24. The wiring for such a control means 19, which will override a thermostat's (not shown) call for heating mode operation when briefly engaged, is not shown, as such wiring and control mechanisms are well understood by those skilled in the art.

The operation of a cooling mode control means 19 in the heating mode, a compressor 1, an electric powered fan 15, a self-adjusting thermal expansion vale 16, and their requisite and appropriate electrical wiring, as well as the operation of all other system components, are well understood by those skilled in the art and are, therefore, neither shown nor described herein in detail.

Figure 2:
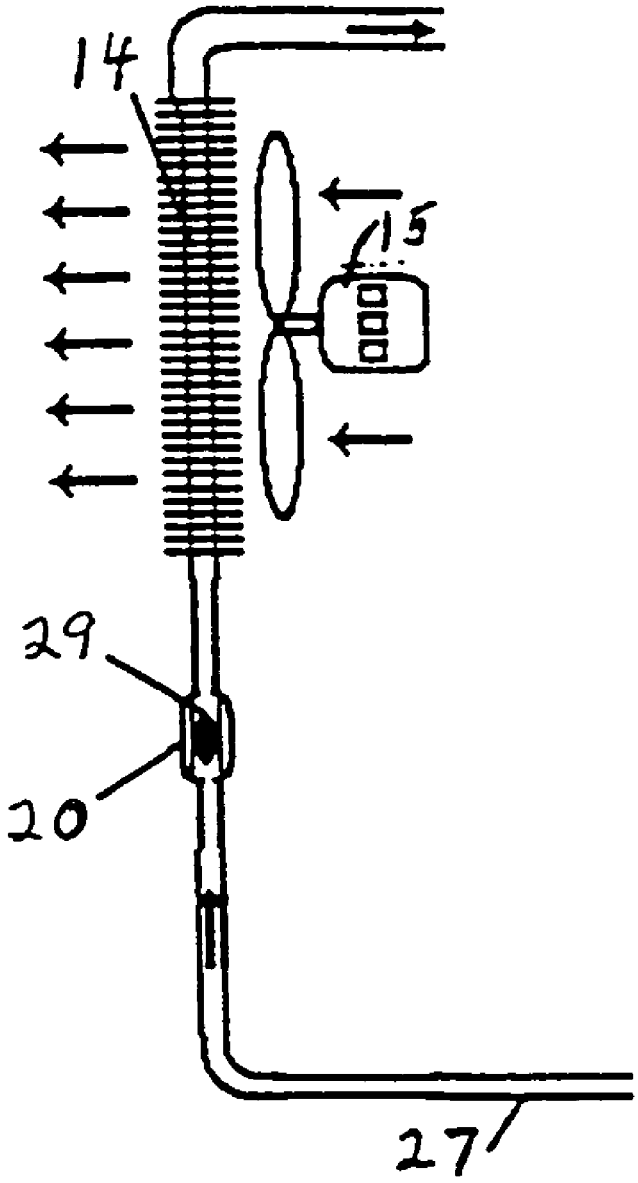
FIG. 2 shows a side view of a refrigerant (not shown) flowing through the optional piston metering device and its pin restrictor, and next through interior located finned heat exchange tubing, also commonly called an air handler, with an adjacent fan designed to blow hot interior air over the cooler refrigerant fluid within the finned heat exchange tubing so as enable the cooler refrigerant to absorb and remove excess heat from the interior air.

FIG. 2 shows a side view of a refrigerant (not shown) flowing through the optional piston metering device 20 and its pin restrictor 29, in lieu of flowing through a self-adjusting thermal expansion valve (not shown in this design), and next through interior located finned heat exchange tubing 14, also commonly called an air handler, with an adjacent fan 15 designed to blow hot interior air over the cooler refrigerant fluid within the finned heat exchange tubing 14 so as enable the cooler refrigerant to absorb and remove excess heat from the interior air.

Figure 3:
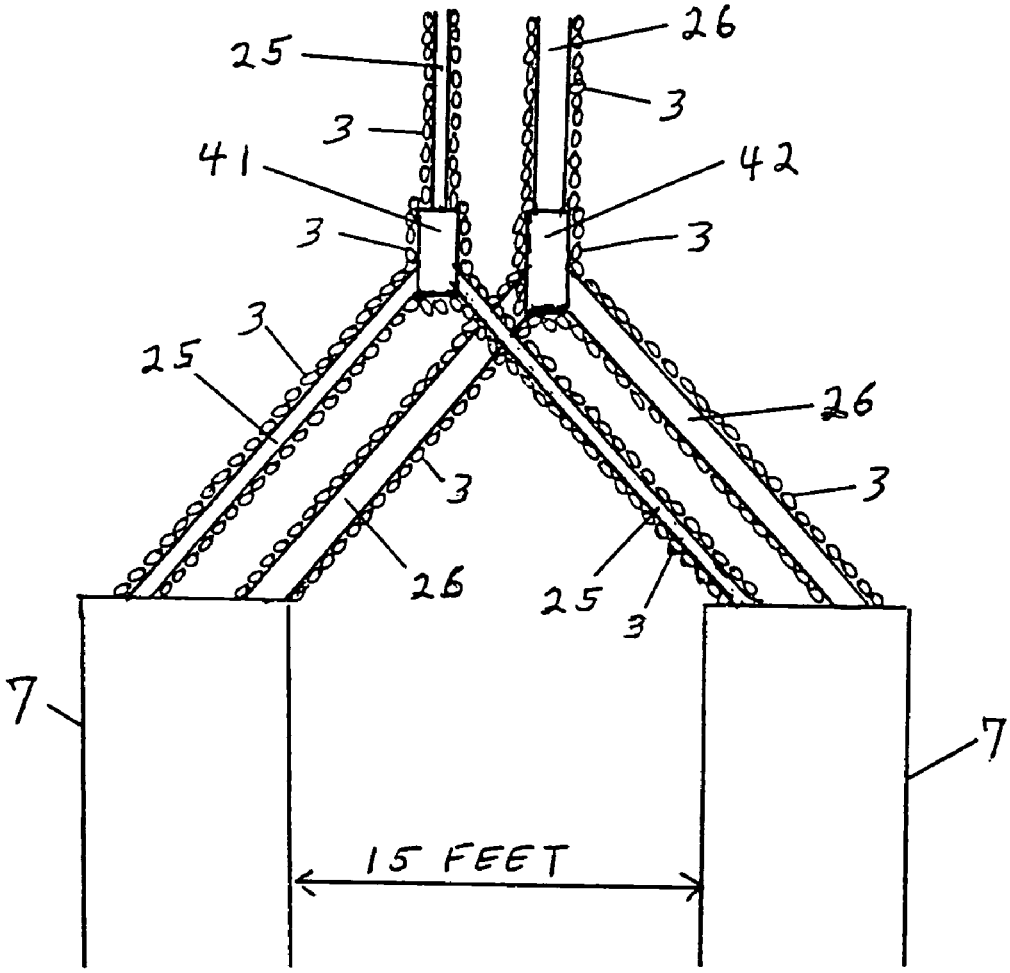
FIG. 3 shows a side view of the top portion of two wells/boreholes, which are spaced the minimum requisite distance apart of fifteen feet. A single connecting exterior refrigerant transport liquid line/tube, surrounded by insulation, and a single connecting exterior refrigerant transport vapor line/tube, surrounded by insulation are shown traveling into a respective liquid line distributor and a vapor line distributor, both surrounded by insulation, where the refrigerant flow (not shown) is equally divided into two separate wells/boreholes.

FIG. 3 shows a side view of the top portion of two wells/boreholes 7, which are spaced the minimum requisite distance apart of fifteen feet. A single connecting exterior refrigerant transport liquid line/tube 25, surrounded by insulation 3, and a single connecting exterior refrigerant transport vapor line/tube 26, surrounded by insulation 3, are shown traveling into a respective liquid line distributor 41 and a vapor line distributor 42, both surrounded by insulation 3, where the refrigerant flow (not shown) is equally divided into two separate wells/boreholes 7 so as not to exceed the recommended 300 foot deep limitation.

Figure 4:
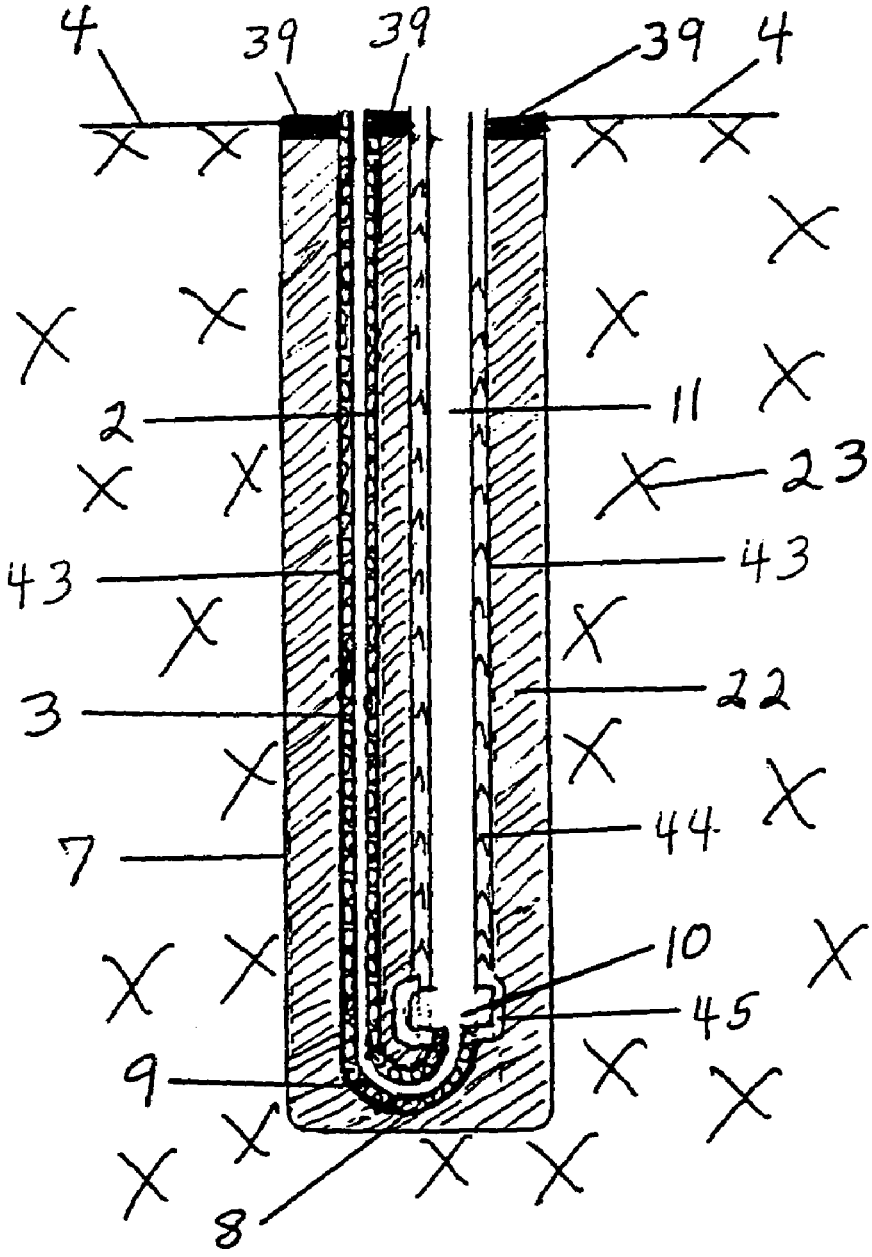
FIG. 4 shows a side view of a deep well/borehole containing a smaller diameter sub-surface liquid refrigerant transport tube/line and a larger diameter sub-surface vapor refrigerant transport tube/line, which are both respectively protected from corrosive soil conditions by means of their own respective encasing watertight pipes. The watertight pipes, in a manner similar to the liquid and vapor refrigerant transport lines, are coupled near the bottom of the well/borehole.

FIG. 4 shows a side view of a deep well/borehole 7, extending below the ground surface 4, containing a smaller diameter sub-surface liquid refrigerant transport tube/line 2 and a larger diameter sub-surface vapor refrigerant transport tube/line 11. The smaller diameter sub-surface liquid refrigerant transport tube/line 2 is surrounded by insulation 3 and is then encased within its own protective watertight pipe 43, which is not required to be heat conductive. The larger diameter sub-surface vapor refrigerant transport tube/line 11 is not insulated and is encased within its own protective watertight pipe 43, which is required to be heat conductive. The respective watertight pipes 43 protect the enclosed refrigerant liquid line 2 and vapor line 11 from surrounding corrosive environment conditions. The area between the larger diameter sub-surface vapor refrigerant transport tube/line 11 and its own protective watertight pipe 43 is filled with one of a heat conductive fluid and gel 44. The respective protective watertight pipes 43 surrounding the smaller diameter sub-surface liquid refrigerant transport tube/line 2 and its insulation 3, and surrounding the larger diameter sub-surface vapor refrigerant transport tube/line 11 which is not insulated, are coupled by means of a protective watertight pipe coupling 45 near the bottom 8 of the well/borehole 7, just above the U bend 9 in the liquid line 2, where the liquid line 2 and the vapor line 11 are joined by means of a refrigerant tube coupling 10. The well/borehole 7 is surrounded by earth 23. The top of the well/borehole 7 is covered with a sealed top 39 to prevent the loss of moisture as a result of evaporation of the heat conductive fluid and gel 44. The space between the exterior of the respective protective pipes 43 and the interior wall of the well/borehole is filled with a heat conductive grout 22.

Figure 5:
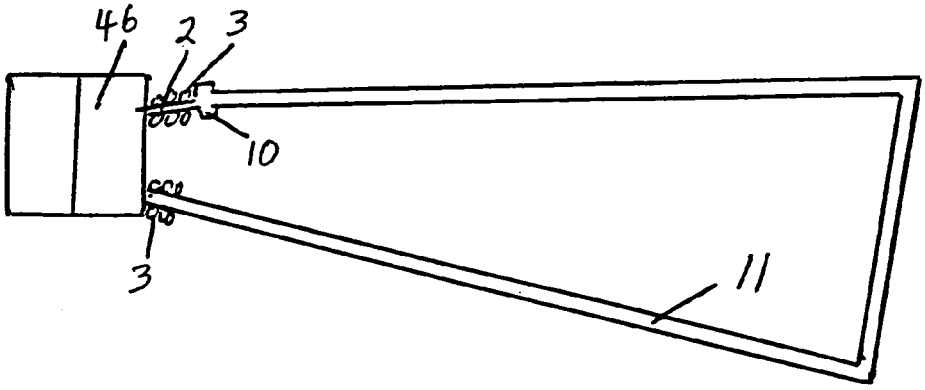
FIG. 5 shows a top view of a LTDX design which enables one to solely extend the vapor line to act as the geothermal heat transfer means, without having to parallel or significantly extend the liquid line.

FIG. 5 shows a top view of a smaller diameter sub-surface liquid refrigerant transport tube/line 2, which is surrounded by insulation 3, extending from interior DX equipment (not shown) within a building 46 to a refrigerant tube coupling 10 at a point (not drawn to scale) about fifteen feet away from the building. At this point, the liquid line 2 is operatively connected by a coupling 10 to a larger diameter sub-surface vapor refrigerant transport tube/line 11, which extends under the ground in a LTDX system design for a distance of 125 feet per ton of maximum heating/cooling load design (not drawn to scale). The vapor line 11 then enters the building 46, always maintaining a distance in excess of ten feet from the other portion of its own loop. The final approximate fifteen feet of the vapor line 11, prior to its entry into the building 46, is surrounded by insulation 3 so as not to potentially freeze ground water adjacent to the building's 46 structural wall. Of note is the ability of such a LTDX design to solely extend the vapor line 11 to act as the geothermal heat transfer means, without having to parallel or significantly extend the liquid line 2. Both the vapor line 11 and the liquid line 2 are operatively connected to the system's interior DX equipment (not shown herein).

Figure 6:
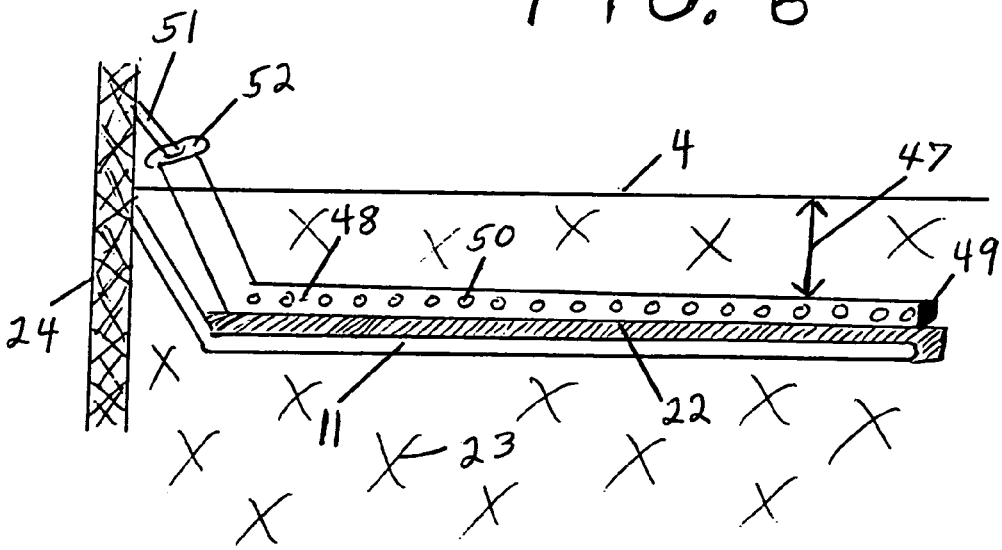
FIG. 6 shows a side view of a larger diameter sub-surface vapor refrigerant transport tube/line extending from an exterior structure wall and traveling beneath the ground surface in a mostly horizontal manner through the earth at a depth which is at least three feet below the maximum frost line in the particular geographic location. The vapor line is shown as being covered with a heat conductive grout, which grout has a soaker hose positioned on its top. The soaker hose is supplied with water from the LTDX system's condensate drain.

FIG. 6 shows a side view of a larger diameter sub-surface vapor refrigerant transport tube/line 11 extending from an exterior structure wall 24 and traveling beneath the ground surface 4 in a mostly horizontal manner through the earth 23 at a depth 47 which is at least three feet below the maximum frost line in the particular geographic location. The vapor line 11 is shown as being covered with a heat conductive grout 22, but the grout 22 may be one of a powdered stone, silica sand, cement, concrete, or the like. On top of the covering of heat conductive grout 22, which grout 22 enhances heat transfer ability, is a perforated soaker hose 48, which extends from a point near the wall 24 along the entire length of the vapor line 11 and its heat conductive grout 22 covering. The distal end of the soaker hose is sealed shut 49, so as to force water to drain out along the perforated holes 50 in the soaker hose 48. A condensate drain line 51 is shown as draining into the open top 52 of the perforated soaker hose 48, so as to continuously supply moisture to the area proximate to the vapor line 11 when the LTDX system is operating in the cooling mode. As is well understood by those skilled in the art, the condensate drain line 51 will only be operative when the DX system is operating in the cooling mode, which is the only time the addition of moisture to the proximate area of the vapor line 11 can be of significant value. Both the vapor line 11 and the liquid line 2 are operatively connected to the system's interior DX equipment (not shown herein).

Figure 7:
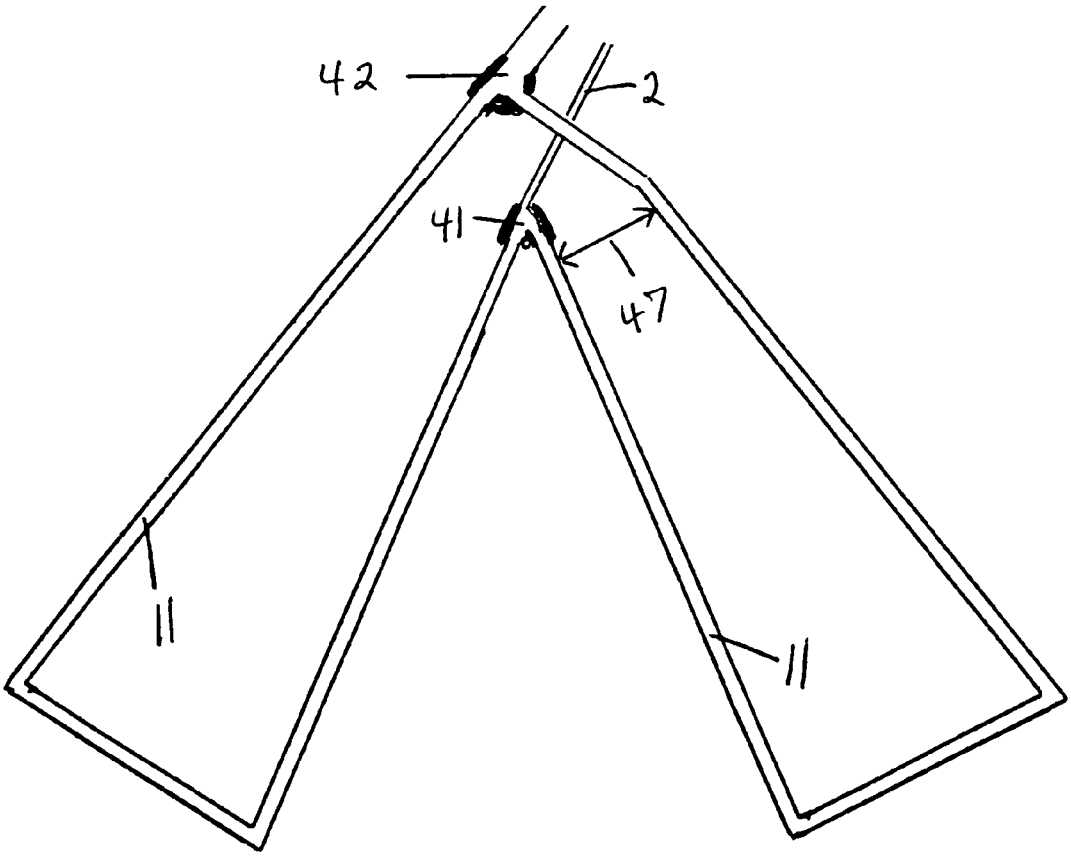
FIG. 7 is a top view of multiple (two in this illustration) LTDX system larger diameter sub-surface vapor refrigerant transport tube/line loops.

FIG. 7 is a top view of multiple (two in this illustration) LTDX system larger diameter sub-surface vapor refrigerant transport tube/line 11 loops, which are distanced 47 at least ten feet apart except at their respective vapor line distributor 42 and liquid line distributor 41. The smaller diameter sub-surface liquid refrigerant transport tube/line 2, operatively connects with the interior LTDX system equipment (not shown herein), as do the two combined vapor lines 11.

Figure 8:
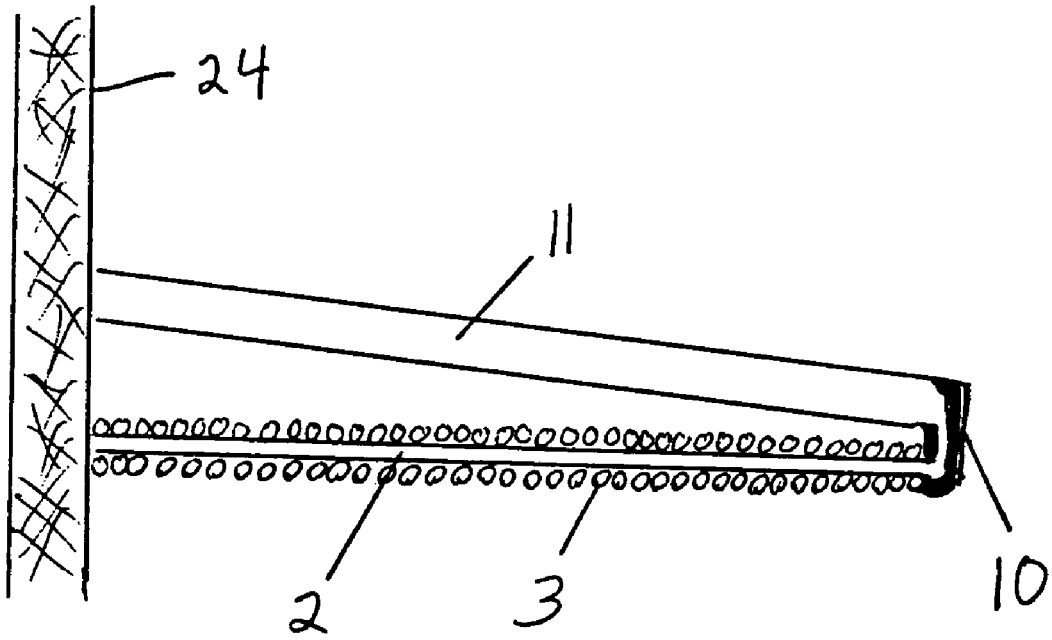
FIG. 8 is a side view of a larger diameter sub-surface vapor refrigerant transport tube/line in a LTDX system design extending from an exterior structure wall in a downwardly sloped manner along its entire length until it reaches a refrigerant tube coupling at its lowest point, where it operatively connects with the system's smaller diameter sub-surface liquid refrigerant transport tube/line.

FIG. 8 is a side view of a larger diameter sub-surface vapor refrigerant transport tube/line 11 in a LTDX system design extending from an exterior structure wall 24 in a downwardly sloped manner along its entire length until it reaches a refrigerant tube coupling 10 at its lowest point. The coupling 10 operatively connects the vapor line 11 with the system's smaller diameter sub-surface liquid refrigerant transport tube/line 2. Both the vapor line 11 and the liquid line 2 are operatively connected to the system's interior DX equipment (not shown herein).

Figure 9:
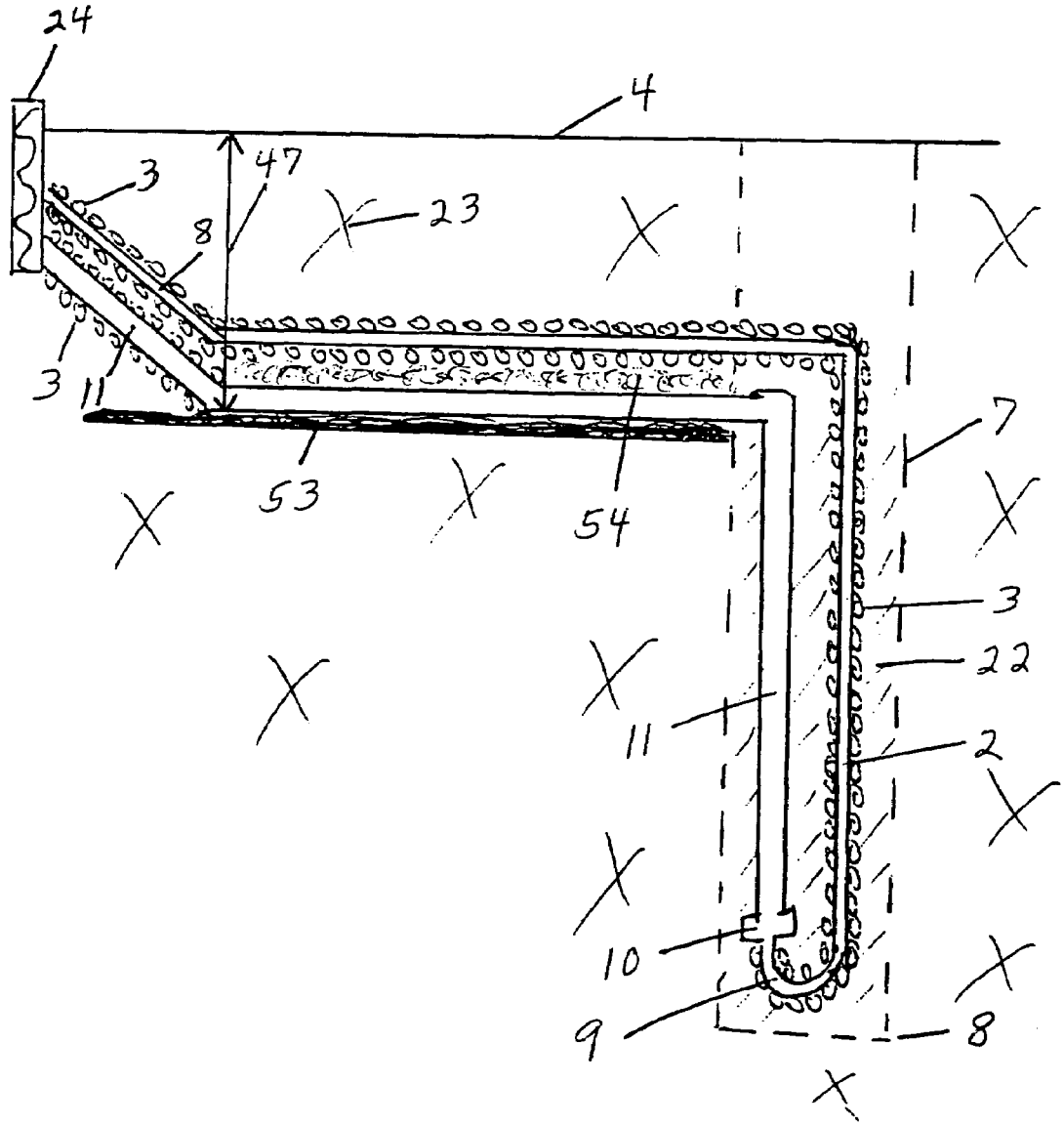
FIG. 9 shows a side view of a trench system and a well/borehole system geothermal heat exchange combination.

FIG. 9 shows a side view of a trench system and a well/borehole system geothermal heat exchange combination. A fully insulated 3 smaller diameter sub-surface liquid refrigerant transport tube/line 2 extends from an exterior structure wall, together with a larger diameter sub-surface vapor refrigerant transport tube/line 11, which vapor line 11 is insulated to a distance 47 of at least three feet below the maximum frost line in the particular geographic location. The liquid line 3 remains fully insulated 3 until it has formed a U bend 9 near the bottom 8 of a well/borehole 7 and it is connected, by means of a refrigerant tube coupling 10, to the vapor line 11. The vapor line 11 remains un-insulated for its entire length along the trench base and down into the well/borehole 7. The space between the interior walls of the well/borehole 7 and the exterior walls of the vapor line 11 and the insulation 3 surrounding the liquid line 2 is filled with a heat conductive grout 22. The vapor line 11 installed on the trench base 53 is covered with heat conductive powdered limestone 54, the insulated 3 liquid line 2 is placed on the top of the powdered limestone 54, and the remainder of the trench below the ground surface 4 is backfilled with earth 23.

Figure 10:
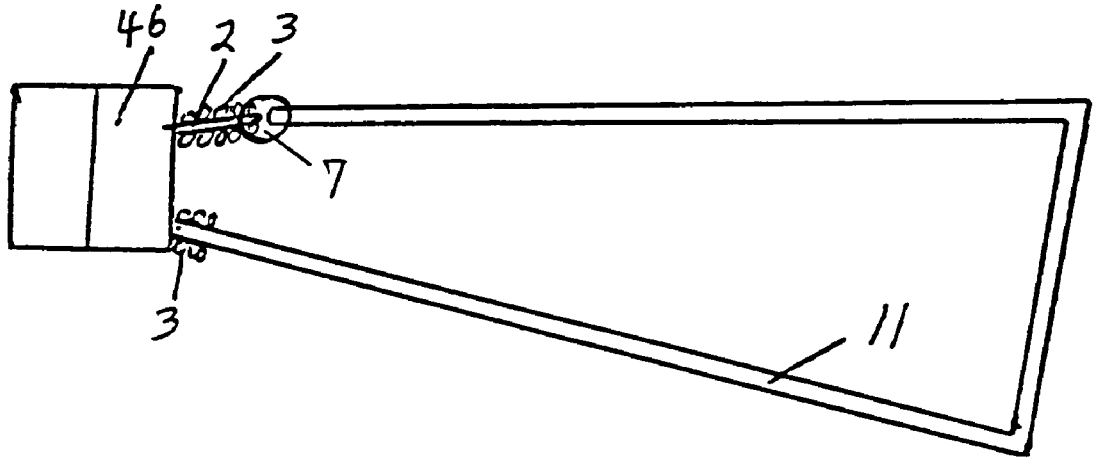
FIG. 10 is a top view of a trench system and a well/borehole system combination, where the system's smaller diameter sub-surface liquid refrigerant transport tube/line only needs to extend to the bottom of the well/borehole, and does not need to parallel the larger diameter sub-surface vapor refrigerant transport tube/line along the entire length of the trench.

FIG. 10 shows a top view of a smaller diameter sub-surface liquid refrigerant transport tube/line 2, which is surrounded by insulation 3, extending from interior DX equipment (not shown) within a building 46 to a well/borehole 7 at a point (not drawn to scale) about fifteen feet away from the building. Near the bottom of the well/borehole (not shown from this top view), the liquid line 2 is operatively connected by a refrigerant tube coupling (not shown from this top view) to the larger diameter sub-surface vapor refrigerant transport tube/line 11, which extends up and out of the well/borehole 7 and continues under the ground in a LTDX system design for a distance of 125 feet per ton of maximum heating/cooling load design (not drawn to scale). The vapor line 11 then enters the building 46, always maintaining a distance in excess of ten feet from the other portion of its own loop. The final approximate fifteen feet of the vapor line 11, prior to its entry into the building 46, is surrounded by insulation 3 so as not to potentially freeze ground water adjacent to the building's 46 structural wall. Of note is the ability of such a LTDX design to solely extend the vapor line 11 to act as the geothermal heat transfer means, without having to parallel or extend the liquid line 2 beyond the bottom of the well/borehole 7. Both the vapor line 11 and the liquid line 2 are operatively connected to the system's interior DX equipment (not shown herein).

Figure 11:
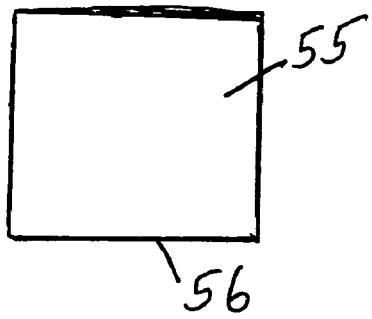
FIG. 11 shows a side view of a rugged plate, with a straight edged bottom for use in crating a trench by means of one of being driven, hammered, pressured, and forced into the ground, a segment at a time, along the path required for the trench.

FIG. 11 shows a side view of a rugged plate 55, with a straight edged bottom 56 for use in crating a trench by means of one of being driven, hammered, pressured, and forced into the ground, a segment at a time, along the path required for the trench.

Figure 12:
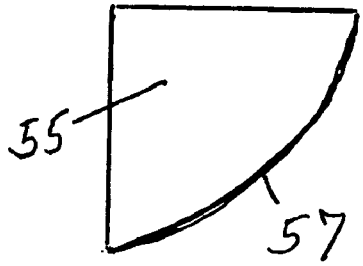
FIG. 12 shows a side view of a rugged plate with a rounded bladed front edge for use in creating a trench by means of one of being driven, hammered, pressured, plowed and forced into and through the ground along the path required for the trench.

FIG. 12 shows a side view of a rugged plate 55 with a rounded bladed front edge 57 for use in creating a trench by means of one of being driven, hammered, pressured, plowed and forced into and through the ground along the path required for the trench.

Figure 13:
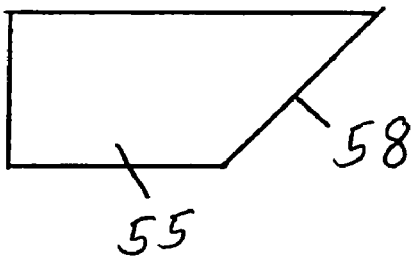
FIG. 13 shows a side view of a rugged plate with an angled bladed front edge for use in creating a trench by means of one of being driven, hammered, pressured, plowed and forced into and through the ground along the path required for the trench.

FIG. 13 shows a side view of a rugged plate 55 with an angled bladed front edge 58 for use in creating a trench by means of one of being driven, hammered, pressured, plowed and forced into and through the ground along the path required for the trench.

Figure 14:
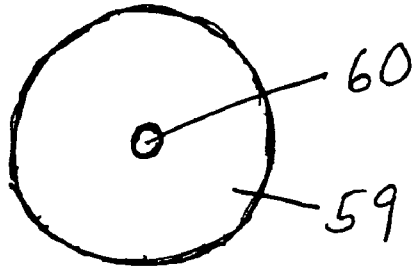
FIG. 14 shows a side view of a rugged plate which is comprised of a wheel with an axel 60 in the center, for use in being one of driven, pressured, and forced into and through the ground along the path required for the trench.

FIG. 14 shows a side view of a rugged plate 55 which is comprised of a wheel 59 with an axel 60 in the center, for use in being one of driven, pressured, and forced into and through the ground along the path required for the trench.

Figure 15:
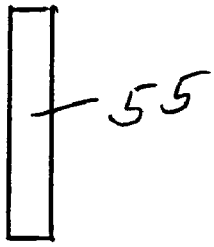
FIG. 15 shows a top view of a rugged plate.

FIG. 15 shows a top view of a rugged plate 55.

Figure 16:
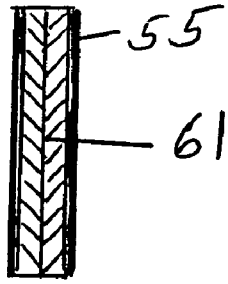
FIG. 16 shows a bottom view of a rugged plate with its tapered and bladed bottom edge.

FIG. 16 shows a bottom view of a rugged plate 55 with its tapered and bladed bottom edge 61.

Thus, although there have been described particular embodiments of the present invention of a new and useful "Deep Well/Long Trench Direct Expansion Heating/Cooling System" it is not intended that such references be construed as limitations upon the scope of this invention except as set forth in the following claims.

What is claimed is:

1. A heat exchange system comprising:

a compressor operable in at least heating and cooling modes;

an interior heat exchanger;

an exterior, sub-surface, heat exchanger, the exterior heat exchanger being positioned at a lower elevation than the compressor;

refrigerant grade tubing connecting the interior heat exchanger and the exterior, sub-surface, heat exchanger with the compressor;

a system refrigerant charging the system, wherein the system refrigerant has a working pressure at least 33% greater than a working pressure of R-22 refrigerant; and wherein the compressor is configured to pressurize the refrigerant at a continuous operational pressure at least 33% greater than the working pressure of R-22 refrigerant in both the heating and cooling modes.

2. The system of claim 1 wherein the system refrigerant comprises R-410A refrigerant.

3. The method of claim 1 further comprising a polyol ester lubricating oil positioned to lubricate the compressor.

4. The method of claim 1 further comprising providing a filter dryer that has been oversized by a factor of at least 10% above the size of a filter dryer used in an R-22 based system.

5. A method of exchanging heat in a direct expansion geothermal heat exchange system, comprising:

providing a compressor operable in at least heating and cooling modes;

providing an above-ground, interior heat exchanger;

providing a sub-surface, exterior heat exchanger positioned at a lower elevation than the compressor;

operably connecting the interior and exterior heat exchangers to the compressor using refrigerant-grade tubing;

charging the geothermal heat exchange system with a system refrigerant having a working pressure at least 33% greater than a working pressure of R-22 refrigerant; and operating the compressor to pressurize the system refrigerant at a continuous operational pressure at least 33% greater than the working pressure of R-22 refrigerant in both the heating and cooling modes.

6. The method of claim 5 wherein the system refrigerant comprises an R-410A refrigerant.

7. The method of claim 6 further comprising providing a polyol ester lubricating oil for the compressor.

8. The method of claim 7 in which the geothermal heat exchange system has a heat exchange capacity, the method further comprising providing a filter dryer in fluid communication with both the interior and exterior heat exchangers, wherein the filter dryer is oversized by a factor of at least 10% in comparison to the size of a filter dryer used in an R-22 based system having a similar heat exchange capacity.

9. A direct expansion geothermal heat exchange system having an operational pressure and a heat exchange capacity, the geothermal heat exchange system including:

a compressor operable in at least heating and cooling modes;

a polyol ester lubricating oil positioned to lubricate the compressor;

an interior heat exchanger;

a filter dryer in fluid communication with the interior heat exchanger, the filter dryer being oversized by a factor of at least 10% in comparison to a size of a filter dryer used in an R-22 based system having a similar heat exchange capacity;

an exterior, sub-surface, heat exchanger, the exterior heat exchanger being positioned at a lower elevation than the compressor;

refrigerant grade tubing connecting the interior heat exchanger and the exterior, sub-surface, heat exchanger with the compressor;

a system refrigerant charging the system, wherein the system refrigerant has a working pressure at least 33% greater than a working pressure of R-22 refrigerant; and wherein the compressor is configured to pressurize the system refrigerant to a continuous operational pressure at least 33% greater than the working pressure of R-22 refrigerant in both the heating and cooling modes.

10. The system of claim 9 in which the system refrigerant comprises R-410A refrigerant.

11. A direct expansion geothermal heat exchange system having an operational pressure and a heat exchange capacity, the geothermal heat exchange system including:

a compressor;

an interior heat exchanger;

an exterior, sub-surface heat exchanger, the exterior heat exchanger being positioned at a lower elevation than the compressor;

refrigerant grade tubing connecting the interior heat exchanger and the exterior heat exchanger with the compressor;

a system refrigerant charging the system, wherein the system refrigerant is an R-410A refrigerant having a working pressure at least 33% greater than a working pressure of R-22 refrigerant; and a polyol ester lubricating oil positioned to lubricate the compressor;

wherein the compressor, interior and exterior heat exchangers, and refrigerant grade tubing are configured to withstand a system operational pressure at least 33% greater than a working pressure of R-22 refrigerant; and wherein the compressor is configured to pressurize the system refrigerant to a continuous operational pressure at least 33% greater than the working pressure of R-22 refrigerant in both the heating and cooling modes.

12. The system of claim 11 in which the system has a filter dryer in fluid communication with the interior heat exchanger, the filter dryer being oversized by a factor of at least 10% in comparison to a size of a filter dryer used in an R-22 based system having a similar heat exchange capacity.

* * * * *